US011313105B2

(12) United States Patent
Ogawa et al.

(10) Patent No.: US 11,313,105 B2
(45) Date of Patent: Apr. 26, 2022

(54) WORK MACHINE

(71) Applicant: Hitachi Construction Machinery Co., Ltd., Tokyo (JP)

(72) Inventors: Yuichi Ogawa, Tsuchiura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/273,959

(22) PCT Filed: Nov. 26, 2019

(86) PCT No.: PCT/JP2019/046212
§ 371 (c)(1),
(2) Date: Mar. 5, 2021

(87) PCT Pub. No.: WO2020/170540
PCT Pub. Date: Aug. 27, 2020

(65) Prior Publication Data

US 2021/0332562 A1 Oct. 28, 2021

(30) Foreign Application Priority Data

Feb. 22, 2019 (JP) ..... JP2019-031036

(51) Int. Cl.
*E02F 9/22* (2006.01)
*F15B 19/00* (2006.01)
*F15B 21/045* (2019.01)

(52) U.S. Cl.
CPC ..... *E02F 9/2228* (2013.01); *E02F 9/2282* (2013.01); *E02F 9/2292* (2013.01); *F15B 19/007* (2013.01); *F15B 21/045* (2013.01)

(58) Field of Classification Search
CPC ..... F15B 2211/7135; F15B 11/17; F15B 2211/31535; F15B 2211/31582;
(Continued)

(56) References Cited

U.S. PATENT DOCUMENTS 9,841,037 B2 * 12/2017 Tho ..... E02F 9/2267
10,563,377 B2 * 2/2020 Kishida ..... E02F 9/2228
(Continued)

FOREIGN PATENT DOCUMENTS

JP 2005-83427 A 3/2005
JP 2011-157790 A 8/2011
JP 2016-61387 A 4/2016

OTHER PUBLICATIONS

International Search Report (PCT/ISA/210) issued in PCT Application No. PCT/JP2019/046212 dated Feb. 4, 2020 (four (4) pages).
(Continued)

*Primary Examiner* — Michael Leslie
*Assistant Examiner* — Daniel S Collins
(74) *Attorney, Agent, or Firm* — Crowell & Moring LLP

(57) ABSTRACT

There is provided a work machine that is capable of realizing operability and energy saving ability that are equivalent to those of work machines that have a joint line to be used during swinging/boom raising operation, without incorporating a joint line for supplying a pressurized fluid from a second pump to a bottom-side chamber of a boom cylinder. The controller is configured to compute a hypothetical flow rate representing a flow rate in a hypothetical joint line, compute a first pump provisional target flow rate on the basis of an operation amount of a boom operation device, compute a second pump provisional target flow rate on the basis of an operation amount of a swing operation device, compute a first pump final target flow rate by adding the hypothetical flow rate to the first pump provisional target flow rate, and compute a second pump final target flow rate by subtracting the hypothetical flow rate from the second pump provisional target flow rate.

9 Claims, 27 Drawing Sheets

(58) Field of Classification Search
CPC ..... F15B 19/17; E02F 9/2288; E02F 9/2282; E02F 9/2292
See application file for complete search history.

(56) References Cited

U.S. PATENT DOCUMENTS

| | | | | |
|---|---|---|---|---|
| 2005/0060993 | A1 | 3/2005 | Oka et al. | |
| 2006/0060993 | A1* | 3/2006 | Mockry | F28F 25/10 261/109 |

OTHER PUBLICATIONS

Japanese-language Written Opinion (PCT/ISA/237) issued in PCT Application No. PCT/JP2019/046212 dated Feb. 4, 2020 (four (4) pages).
International Preliminary Report on Patentability (PCT/IB/338 & PCT/IB/373) issued in PCT Application No. PCT/JP2019/046212 dated Sep. 2, 2021, Including English translation of document C2 (Japanese-language Written Opinion (PCT/ISA/237), filed on Mar. 5, 2021) (five (5) pages).

* cited by examiner

FIG. 8

$$\left\{\begin{array}{ll} Q_v = c_1 A_{40}\sqrt{\frac{2(P_{32}-P_{31})}{\rho}} & (if \quad P_{32} - P_{31} \geq 0) \\ Q_v = 0 & (if \quad P_{32} - P_{31} < 0) \end{array}\right\} \quad (1)$$

FIG. 15

$$A_v = \sqrt{\frac{A_{40}^{\ 2} \cdot A_{19u}^{\ 2}}{A_{40}^{\ 2} + A_{19u}^{\ 2}}} \qquad (2)$$

$$\left\{ \begin{array}{ll} Q_v = c_1 A_v \sqrt{\frac{2(P_{32} - P_{44})}{\rho}} & (if \quad P_{32} - P_{44} \geq 0) \\ Q_v = 0 & (if \quad P_{32} - P_{44} < 0) \end{array} \right\} \qquad (3)$$

FIG. 20

$$\left\{\begin{array}{ll} Q_v = c_1\, A_{45}\sqrt{\frac{2(P_{32}-P_{44})}{\rho}} & (if \quad P_{32}-P_{44} \geq 0) \\ Q_v = 0 & (if \quad P_{32}-P_{44} < 0) \end{array}\right\} \quad (4)$$

FIG. 27

$$\left\{\begin{array}{ll} Q_v = \frac{\pi \cdot D^4}{128 \cdot \mu} \cdot \frac{P_{32} - P_{31}}{L} & (if \quad P_{32} - P_{31} \geq 0) \\ Q_v = 0 & (if \quad P_{32} - P_{31} < 0) \end{array}\right\} \quad (5)$$

WORK MACHINE

TECHNICAL FIELD

The present invention relates to a work machine such as a hydraulic excavator.

BACKGROUND ART

Generally, work machines such as hydraulic excavators operate by supplying a pressurized fluid from a hydraulic pump to hydraulic actuators to drive the hydraulic actuators. The hydraulic actuators include a swing motor for swinging an upper structure (upper swing structure) of a work machine with respect to a lower structure (lower track structure) and a boom cylinder for moving a boom. The hydraulic excavators frequently perform swinging/boom raising operation for simultaneously operating the swing motor and the boom cylinder.

In order to maintain operability during swinging/boom raising operation, there has been disclosed a load sensing system in which a split flow pump has a first delivery port connected to a boom cylinder and a second delivery port connected to a swing motor, and a joint line is provided to supply part of a pressurized fluid from the second delivery port to the boom cylinder for raising the boom at a sufficient speed during swinging/boom raising operation (see, for example, Patent Document 1). The technology of Patent Document 1 makes it possible to restrain a wasteful pressurized fluid from being discharged from an unloading valve in an initial swinging state, thereby efficiently performing swinging/boom raising operation. Though the technology of Patent Document 1 deals with the load sensing system, it is also effective when applied to an open center system as it can reduce a swinging relief flow rate during swinging/boom raising operation.

As regards a process of reducing a hydraulic pressure loss during swinging operation, there has also been disclosed a system for restraining a flow rate by stepwise limiting torques absorbed by a hydraulic pump to thereby restrain a relief flow rate during swinging operation (see, for example, Patent Document 2). However, the disclosed system is problematic in that, when the moment of inertia of the machine body varies continuously while in action such as swinging/boom raising operation, it is difficult to decide an optimum torque limiting value each time the moment of inertia varies. Installing a sensor for detecting the posture of the machine body would make it possible to decide an optimum torque limiting value at the expense of the cost. Patent Document 1 is advantageous in that its technology can reduce a swinging relief flow rate without deciding an optimum torque limiting value.

PRIOR ART DOCUMENT

Patent Documents

Patent Document 1: JP-2016-61387-A
Patent Document 2: JP-2011-157790-A

SUMMARY OF THE INVENTION

Problem to be Solved by the Invention

As described above, the system disclosed in Patent Document 1 is able to reduce a swinging relief flow rate during swinging/boom raising operation. However, the system disclosed in Patent Document 1 causes the fluid to flow through a shunt in an initial swing starting stage, resulting in a hydraulic pressure loss in the joint line.

The present invention has been made in view of the above problems. It is an object of the present invention to provide a work machine that is capable of realizing operability and energy saving ability that are equivalent to those of work machines that have a joint line to be used during swinging/boom raising operation, without incorporating a joint line for supplying a pressurized fluid from a second pump to a bottom-side chamber of a boom cylinder.

Means for Solving the Problem

In order to accomplish the above object, there is provided in accordance with the present invention a work machine including a lower track structure, an upper swing structure swingably mounted on the lower track structure, a work implement angularly movably mounted on the upper swing structure and having a boom, a boom cylinder for driving the boom, a swing motor for driving the upper swing structure, a boom operation device for operating the boom, a swing operation device for operating the upper swing structure, a first pump and a second pump as variable-displacement-type hydraulic pumps, a first regulator for controlling a delivery flow rate of the first pump, a second regulator for controlling a delivery flow rate of the second pump, a boom control valve for controlling a flow of a pressurized fluid supplied from the first pump to the boom cylinder, a swing control valve for controlling a flow of a pressurized fluid supplied from the second pump to the swing motor, and a controller configured to control the first regulator depending on an operation amount of the boom operation device and control the second regulator depending on an operation amount of the swing operation device. The controller is configured to assume that a line for supplying the pressurized fluid from the first pump to a bottom-side chamber of the boom cylinder and the second pump are interconnected by a hypothetical joint line, compute a hypothetical flow rate representing a flow rate in the hypothetical joint line, compute a first pump provisional target flow rate representing a provisional target flow rate for the first pump on a basis of the operation amount of the boom operation device, compute a second pump provisional target flow rate representing a provisional target flow rate for the second pump on a basis of an operation amount of the swing operation device, compute a first pump final target flow rate representing a final target flow rate for the first pump by adding the hypothetical flow rate to the first pump provisional target flow rate, and compute a second pump final target flow rate representing a final target flow rate for the second pump by subtracting the hypothetical flow rate from the second pump provisional target flow rate.

According to the present invention arranged as described above, as the work machine has no joint line for supplying the pressurized fluid from the second pump to the bottom-side chamber of the boom cylinder, the work machine is able to reduce a pressure loss due to a shunt compared with work machines that have such a joint line. Moreover, since the delivery flow rate of the first pump is increased from the provisional target flow rate by the hypothetical flow rate during swinging/boom raising operation, the work machine can achieve operability equivalent to that of the work machines that have the joint line. Furthermore, since the delivery flow rate of the second pump is reduced from the provisional target flow rate by the hypothetical flow rate during swinging/boom raising operation, the work machine can achieve energy saving ability equivalent to that of the work machines that have the joint line.

Advantages of the Invention

The work machine according to the present invention is capable of realizing operability and energy saving ability that are equivalent to those of work machines that have a joint line to be used during swinging/boom raising operation, without incorporating a joint line for supplying a pressurized fluid from the second pump to the bottom-side chamber of the boom cylinder.

BRIEF DESCRIPTION OF THE DRAWINGS

FIG. 8 is a diagram illustrating a computation formula for computing a flow rate in a hypothetical joint line for the first embodiment.

FIG. 15 is a diagram illustrating a computation formula for computing a combined opening degree and a computation formula for computing a flow rate of a hypothetical joint line for the second embodiment.

FIG. 20 is a diagram illustrating a computation formula for computing a flow rate in a hypothetical joint line for the third embodiment.

FIG. 27 is a diagram illustrating a computation formula for computing a flow rate in a hypothetical joint line for the fifth embodiment.

MODES FOR CARRYING OUT THE INVENTION

Figure 1:
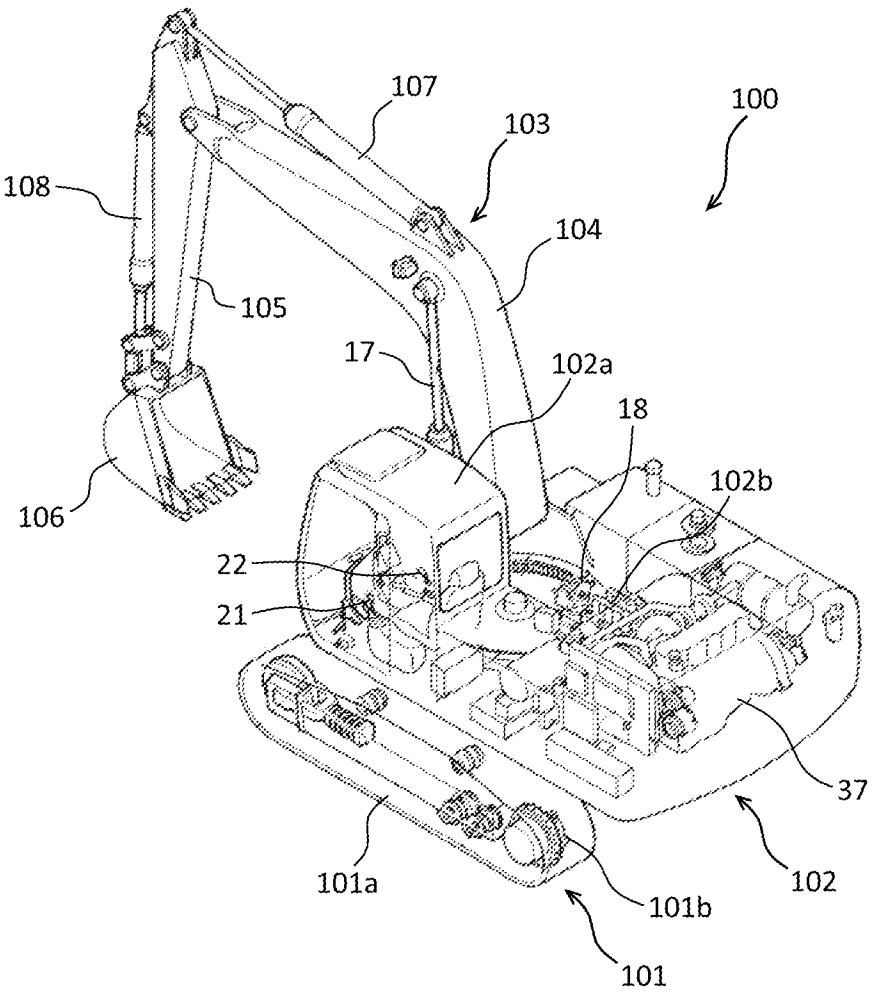
FIG. 1 is a view illustrating a makeup of a hydraulic excavator for a first embodiment.

Hydraulic excavators, for example, as work machines according to embodiments of the present invention will hereinafter be described below with reference to the drawings. Throughout the drawings, equivalent components are denoted by identical reference characters, and their redundant description will be omitted.

First Embodiment

A first embodiment of the present invention will be described below with reference to FIGS. 1 through 9.

A makeup of a hydraulic excavator for the first embodiment will be described below with reference to FIG. 1.

In FIG. 1, a hydraulic excavator 100 includes a lower track structure 101, an upper swing structure 102 swingably mounted on the lower track structure 101, and a work implement 103 attached to a front side of the upper swing structure 102.

The lower track structure 101 includes left and right crawler-type track devices 101*a* (only the left track device is illustrated in FIG. 1). The left track device 101*a* has a left crawler (crawler belt) that rotates forwardly or rearwardly when a track motor 101*b* rotates forwardly or rearwardly. Similarly, the right track device has a right crawler (crawler belt) rotates forwardly or rearwardly when a right track motor rotates forwardly or rearwardly. The lower track structure 101 travels accordingly.

The upper swing structure 102 is swung leftwardly or rightwardly in response to rotation of a swing motor 18. An operation room 102*a* is mounted on a front portion of the upper swing structure 102, and an engine 37, a control valve 102*b*, etc. are mounted on a rear portion of the upper swing structure 102. The operation room 102*a* houses therein operation levers 21 and 22, etc. for operating the work implement 103 and the upper swing structure 102.

The control valve 102*b* has a plurality of directional control valves including directional control valves 19 and 20 (illustrated in FIG. 2), and controls flows (flow rates and directions) of a pressurized fluid supplied from hydraulic pumps 1 and 2 (illustrated in FIG. 2) to actuators including a boom cylinder 17, the swing motor 18, etc.

The work implement 103 includes a boom 104 angularly movably coupled to the front side of the upper swing structure 102, an arm 105 angularly movably coupled to a distal end of the boom 104, and a bucket 106 angularly movably coupled to a distal end of the arm 105. The boom 104 is angularly moved upwardly or downwardly by the boom cylinder 17 as it is extended or contracted. The arm 105 is angularly moved in a crowding direction (pulling direction) or a dumping direction (pushing direction) by an arm cylinder 107 as it is extended or contracted. The bucket 106 is angularly moved in a crowding direction or a dumping direction by a bucket cylinder 108 as it is extended or contracted.

Figure 2:
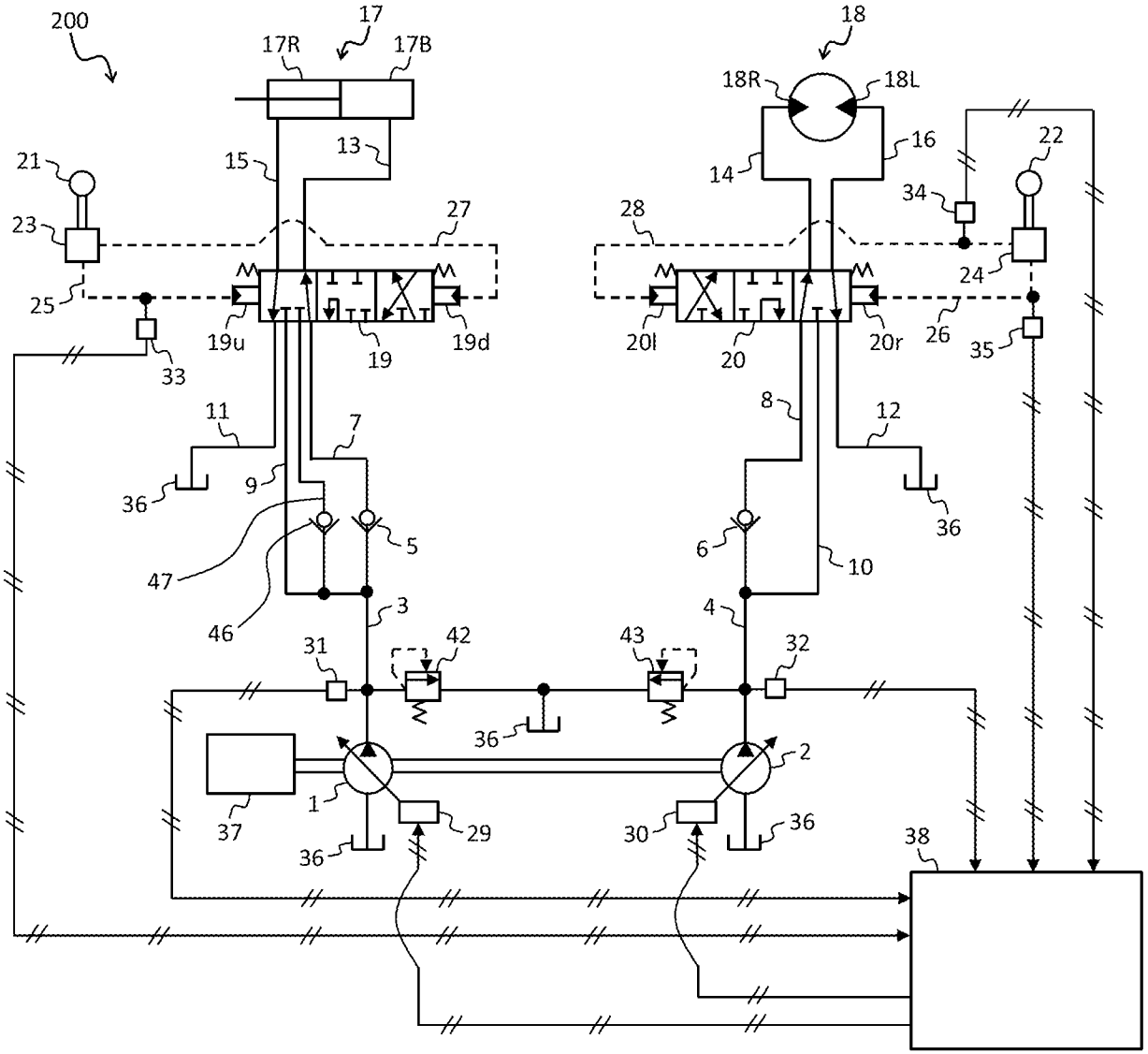
FIG. 2 is a diagram illustrating an actual arrangement of a hydraulic control system for the first embodiment.

An actual arrangement of a hydraulic control system mounted on the hydraulic excavator 100 will be described below with reference to FIG. 2. In FIG. 2, only those components that are involved in driving the boom cylinder 17 and the swing motor 18 are illustrated, and those components that are involved in driving the other actuators are omitted from illustration.

In FIG. 2, the hydraulic control system, denoted by 200, includes a tank 36, the engine 37, the hydraulic pumps 1 and 2, the boom cylinder 17, the swing motor 18, the directional control valves 19 and 20, the operation levers 21 and 22, and a controller 38.

The hydraulic pump 1 (hereinafter also referred to as "first pump") is a variable-displacement-type hydraulic pump actuated by the engine 37, and is connected to a regulator 29 (first regulator) for controlling a delivery flow rate thereof. The first pump 1 has a delivery port connected to a line 3. A line 4 is connected through a relief valve 42 to the tank 36. When a discharge pressure of the first pump 1 exceeds a preset pressure of the relief valve 42, the pressurized fluid flows from the first pump 1 through the relief valve 42 into the tank 36. A pressure sensor 31 (first pump pressure sensor) for detecting the discharge pressure of the first pump 1 is attached to the line 3. Lines 7, 9, and 47 are connected to the line 3 downstream of the pressure sensor 31. Check valves 5 and 46 are provided respectively in the lines 7 and 47. The check valves 5 and 46 allow the pressurized fluid to flow from the first pump 1 toward the directional control valve 19 to be described later, and prevent the pressurized fluid to flow in the opposite direction.

The directional control valve 19 is connected downstream of the lines 7, 9, and 47. The directional control valve 19 is connected to a bottom-side chamber 17B of the boom cylinder 17 through a boom bottom line 13, to a rod-side chamber 17R of the boom cylinder 17 through a boom rod line 15, and to the tank 36 through a tank line 11.

A pilot valve 23 that is attached to the operation lever 21 is connected through lines 25 and 27 to respective operation ports 19*u* and 19*d* of the directional control valve 19. The pilot valve 23 applies a pressure (pilot pressure) depending on an operation amount of the operation lever 21 to the operation port 19*u* or 19*d* of the directional control valve 19. A pressure sensor 33 (operation amount sensor) for detecting the pressure (boom raising pilot pressure) acting on the operation port 19*u* is attached to the line 25.

The hydraulic pump 2 (hereinafter also referred to as "second pump") is a variable-displacement-type hydraulic pump actuated by the engine 37, and is connected to a regulator 30 (second regulator) for controlling a delivery flow rate thereof. The second pump 2 has a delivery port connected to the line 4. The line 4 is connected through a relief valve 43 to the tank 36. When a discharge pressure of the second pump 2 exceeds a preset pressure of the relief valve 43, the pressurized fluid flows from the second pump 2 through the relief valve 43 into the tank 36. A pressure sensor 32 (second pump pressure sensor) for detecting the discharge pressure of the second pump 2 is attached to the line 4. Lines 8 and 10 are connected to the line 4 downstream of the pressure sensor 32. A check valve 6 is provided in the line 8. The check valve 6 allows the pressurized fluid to flow from the second pump 2 toward the directional control valve 20 to be described later, and prevents the pressurized fluid to flow in the opposite direction.

The directional control valve 20 is connected downstream of the lines 8 and 9. The directional control valve 20 is connected to a right-rotation-side chamber 18R of the swing motor 18 through a right rotation line 14, to a left-rotation-side chamber 18L of the swing motor 18 through a left rotation line 16, and to the tank 36 through a tank line 12.

A pilot valve 24 that is attached to the operation lever 22 is connected through lines 26 and 28 to respective operation ports 20*r* and 201 of the directional control valve 20. The pilot valve 24 applies a pressure (pilot pressure) depending on an operation amount of the operation lever 22 to the operation port 20*r* or 201 of the directional control valve 20. A pressure sensor 35 (operation amount sensor) for detecting the pressure (right swing pilot pressure) acting on the operation port 20*r* is attached to the line 26. A pressure sensor 34 (operation amount sensor) for detecting the pressure (left swing pilot pressure) acting on the operation port 201 is attached to the line 28.

The controller 38 is electrically connected to the pressure sensors 31 through 35 and the regulators 29 and 30. The controller 38 decides respective target flow rates for the hydraulic pumps 1 and 2 on the basis of signals from the pressure sensors 31 through 35, and controls the regulators 29 and 30 depending on the target flow rates.

The actual arrangement of the hydraulic control system 200 for the first embodiment has been described above.

Figure 3:
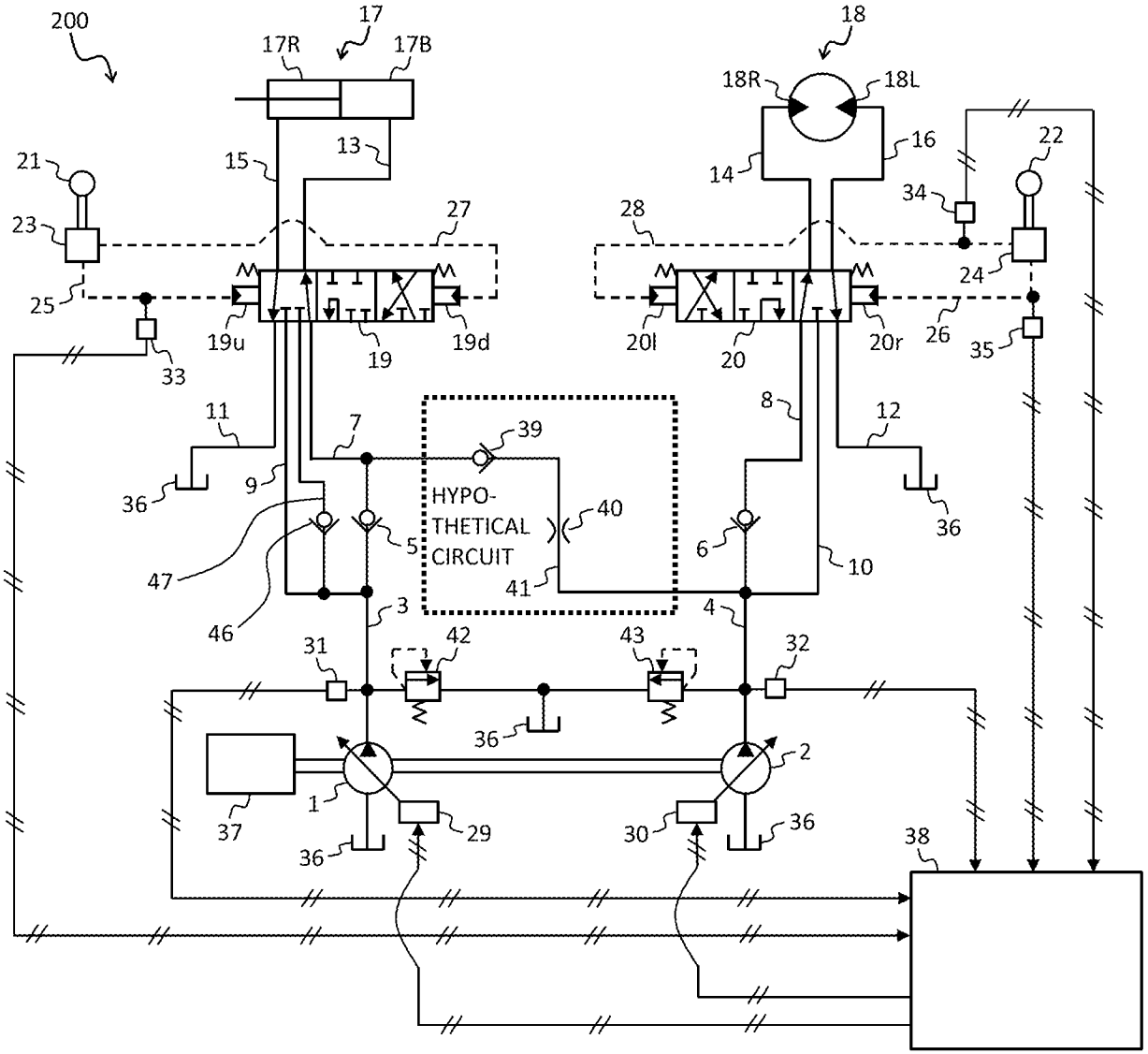
FIG. 3 is a diagram illustrating an arrangement of a hydraulic control system including a hypothetical circuit for the first embodiment.

Next, an arrangement of the hydraulic control system 200 that includes a hypothetical circuit for the first embodiment will be described below with reference to FIG. 3.

A hypothetical joint line 41 for the present embodiment interconnects a junction between the line 4, the line 8, and the line 10 and a freely-selected point positioned on the line 7 downstream of the check valve 5. A hypothetical restrictor 40 and a hypothetical check valve 39 are provided in the hypothetical joint line 41. The hypothetical check valve 39 allows the pressurized fluid to flow hypothetically in a direction from the line 4 to the line 7, but prevents the pressurized fluid from flowing in the opposite direction. The hypothetical joint line 41, the hypothetical restrictor 40, and the hypothetical check valve 39 make up the hypothetical circuit for the present embodiment.

The arrangement of the hydraulic control system 200 that includes the hypothetical circuit for the first embodiment has been described above.

Figure 4:
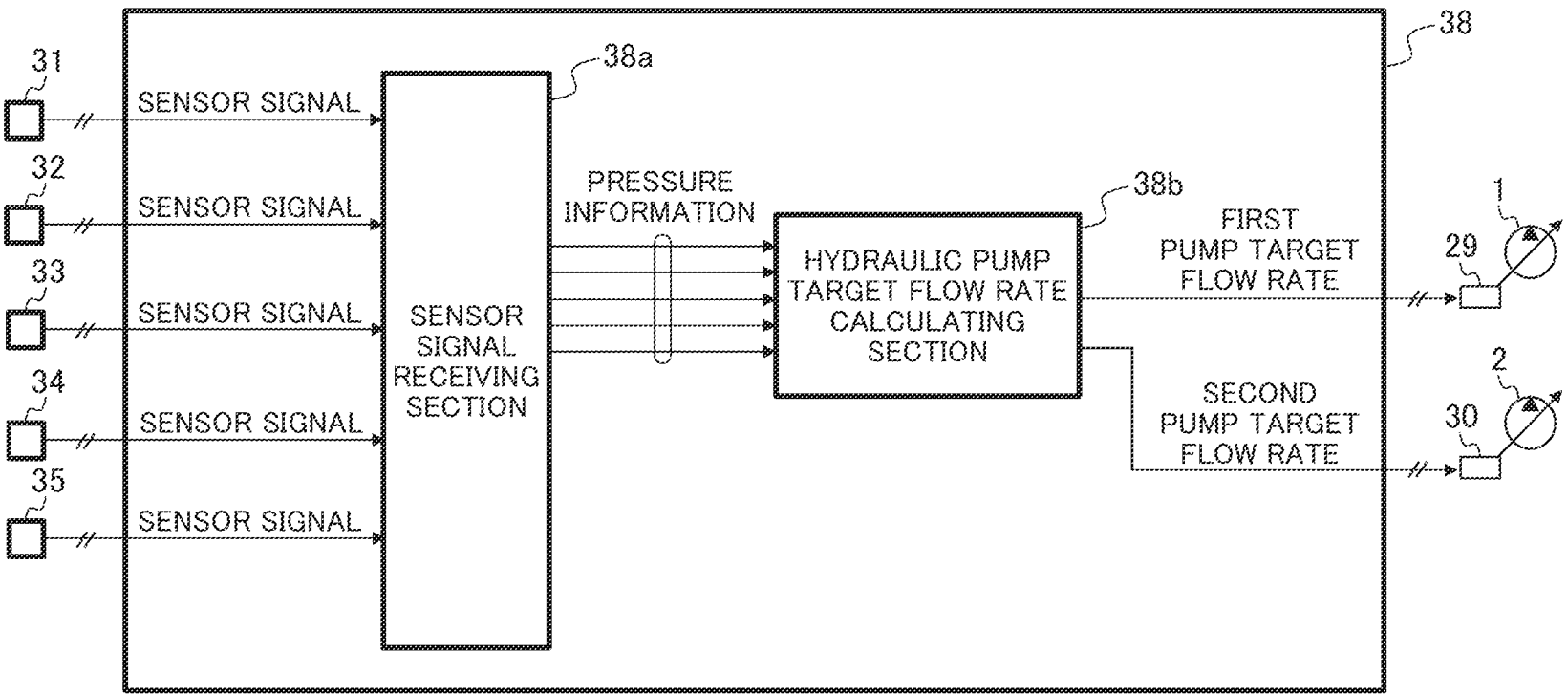
FIG. 4 is a diagram illustrating functions of a controller for the first embodiment.

Next, functions of the controller 38 for the first embodiment will be described below with reference to FIG. 4. The controller 38 has a sensor signal receiving section 38*a* and a hydraulic pump target flow rate calculating section 38*b*.

The sensor signal receiving section 38*a* converts the signals sent from the pressure sensors 31 through 35 into pressure information and transmits the pressure information to the hydraulic pump target flow rate calculating section 38*b*.

The hydraulic pump target flow rate calculating section 38*b* receives the pressure information from the sensor signal receiving section 38*a* and calculates a target flow rate for the first pump 1 and a target flow rate for the second pump 2. Then, the hydraulic pump target flow rate calculating section 38*b* outputs the target flow rates for the respective pumps as command values to the respective regulators 29 and 30.

Next, functions of the hydraulic pump target flow rate calculating section 38*b* for the first embodiment will be described below with reference to FIG. 5. The hydraulic pump target flow rate calculating section 38*b* has a provisional target flow rate calculating section 38*b*-1, a constant storage section 38*b*-2, and a final target flow rate calculating section 38*b*-3.

The provisional target flow rate calculating section 38*b*-1 is a section that calculates provisional target flow rates for the respective hydraulic pumps 1 and 2. The provisional target flow rate calculating section 38*b*-1 inputs a detected value (P33) from the pressure sensor 33 into a table (FIG. 6(*a*)) possessed thereby and uses an output from the table as a provisional target flow rate (Q1, org) for the first pump 1. Furthermore, the provisional target flow rate calculating section 38*b*-1 inputs a larger one of detected values (P34, P35) from the pressure sensors 34 and 35 into a table (FIG. 6(*b*)) possessed thereby and uses an output from the table as a provisional target flow rate (Q2, org) for the second pump 2. Then, the provisional target flow rate calculating section 38*b*-1 transmits the provisional target flow rate (Q1, org) for the first pump 1 and the provisional target flow rate (Q2, org) for the second pump 2 to the final target flow rate calculating section 38*b*-3.

The constant storage section 38*b*-2 transmits information on constants to be used by the final target flow rate calculating section 38*b*-3 to the final target flow rate calculating section 38*b*-3. According to the present embodiment, the constant storage section 38*b*-2 transmits values of an opening degree (A40) of the hypothetical restrictor 40, a flow rate coefficient (cl), a density (p) of a hydraulic working fluid, a maximum flow rate (Q1, MAX) of the first pump 1, a minimum flow rate (Q2, min) of the second pump 2, and a threshold value (Pth) for operation pressures to the final target flow rate calculating section 38*b*-3.

The provisional target flow rate calculating section 38*b*-1 is a section that calculates a final target flow rate for the first pump 1. The final target flow rate calculating section 38*b*-3 receives the provisional target flow rate (Q1, org) for the first pump 1 and the provisional target flow rate (Q2, org) for the second pump 2 from the provisional target flow rate calculating section 38*b*-1, receives the values of the opening degree (A40) of the hypothetical restrictor 40, the flow rate coefficient (cl), the density (p) of the hydraulic working fluid, the maximum flow rate (Q1, MAX) of the first pump 1, the minimum flow rate (Q2, min) of the second pump 2, and the threshold value (Pth) for operation pressures from the constant storage section 38*b*-2, receives the pressure information on the pressure sensors 31 through 35 from the sensor signal receiving section 38*a*, and outputs command values (Q1, tgt, Q2, tgt) to the respective regulators 29 and 30.

Next, a processing sequence for calculating a target flow rate value for the first embodiment will be described below with reference to FIG. 7.

Figure 5:
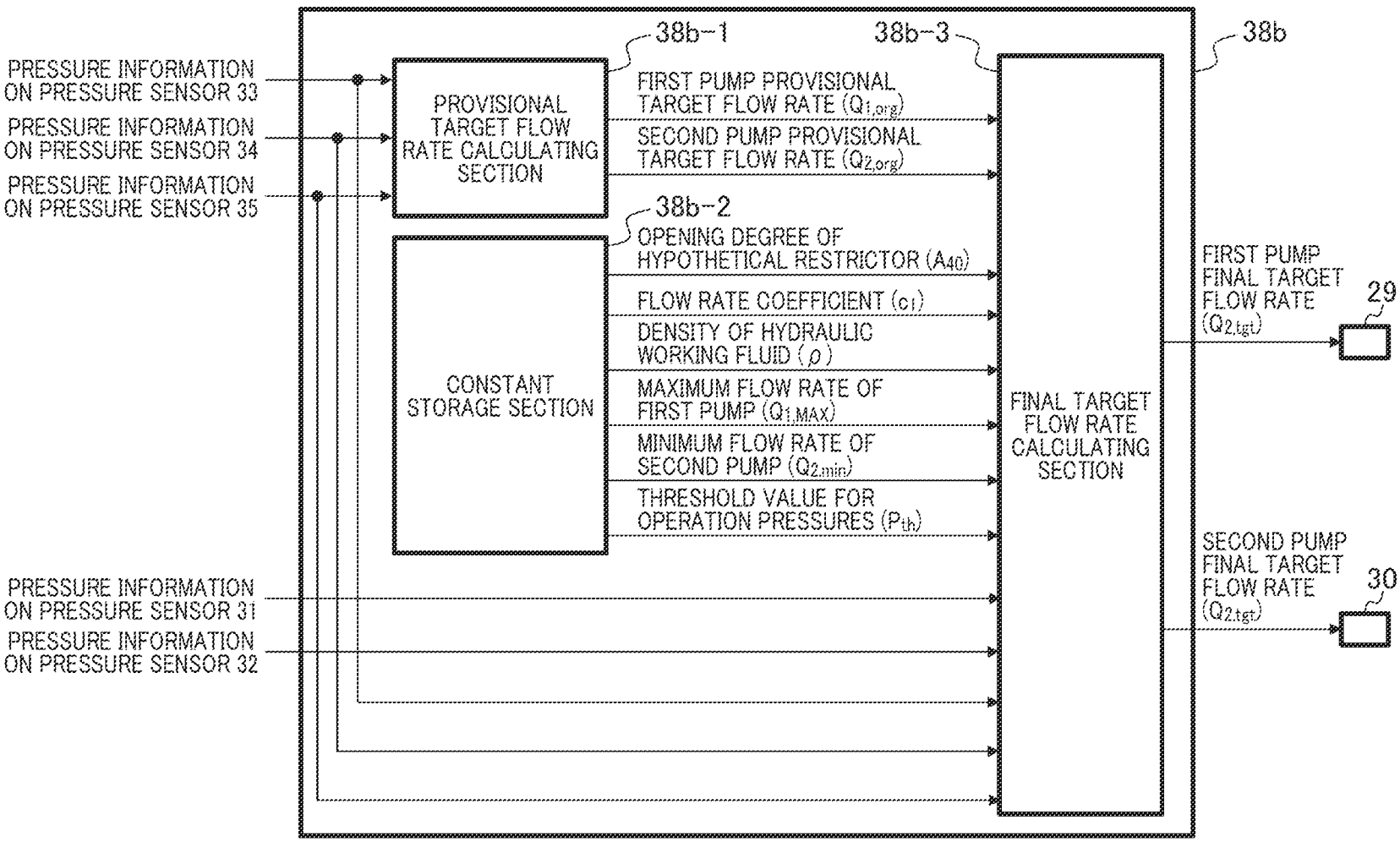
FIG. 5 is a diagram illustrating functions of a hydraulic pump target flow rate calculating section for the first embodiment.
Figure 6:
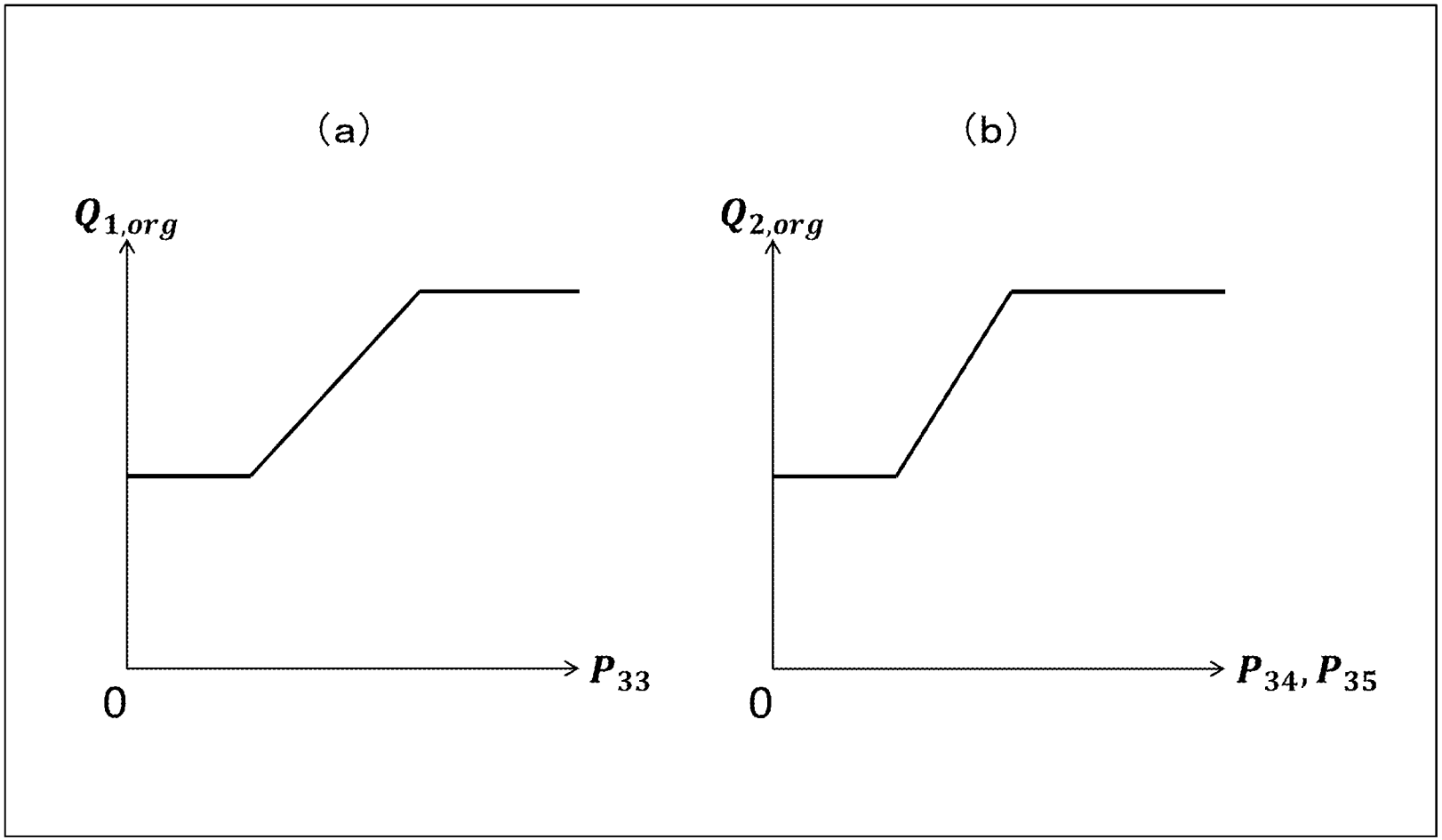
FIG. 6 is a diagram illustrating a relation between a boom pilot pressure and a provisional target flow rate for a first pump and a relation between a swing pilot pressure and a provisional target flow rate for a second pump for the first embodiment.
Figure 7:
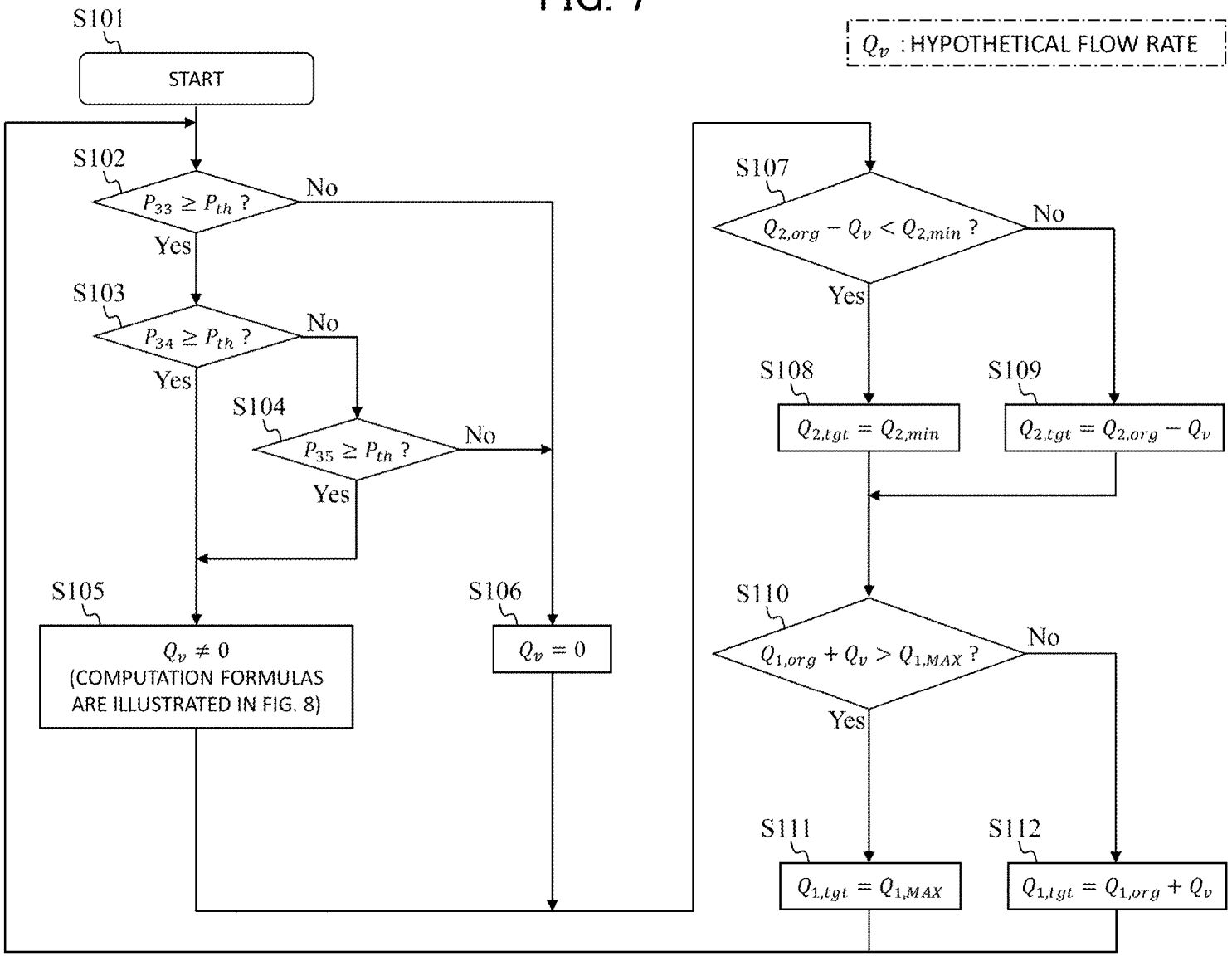
FIG. 7 is a flowchart of a processing sequence for calculating a target flow rate value for the first embodiment.

FIG. 7 is a flowchart of a processing sequence executed by the final target flow rate calculating section 38*b*-3 illustrated in FIG. 5. The processing sequence is repeatedly executed while the controller 38 is in operation, for example.

When the controller 38 is activated, the final target flow rate calculating section 38*b*-3 starts to execute the processing sequence from step S101.

In step S102, the final target flow rate calculating section 38*b*-3 determines whether or not the pressure at the operation port 19*u* of the directional control valve 19 is equal to or higher than the threshold value (Pth). The pressure information at the operation port 19*u* has been acquired by the pressure sensor 33. If the pressure (P33) at the operation port 19*u* is equal to or higher than the threshold value (Pth), then the final target flow rate calculating section 38*b*-3 determines that the answer is Yes in step S102, and control goes to step S103. If the pressure (P33) at the operation port 19*u* is lower than the threshold value (Pth), then the final target flow rate calculating section 38*b*-3 determines that the answer is No in step S102, and control goes to step S106.

In step S103, the final target flow rate calculating section 38*b*-3 determines whether or not the pressure at the operation port 201 of the directional control valve 20 is equal to or higher than the threshold value (Pth). The pressure information at the operation port 201 has been acquired by the pressure sensor 34. If the pressure (P34) at the operation port 201 is equal to or higher than the threshold value (Pth), then the final target flow rate calculating section 38*b*-3 determines that the answer is Yes in step S103, and control goes to step S105. If the pressure (P34) at the operation port 201 is lower than the threshold value (Pth), then the final target flow rate calculating section 38*b*-3 determines that the answer is No in step S103, and control goes to step S104.

In step S104, the final target flow rate calculating section 38*b*-3 determines whether or not the pressure at the operation port 20*r* of the directional control valve 20 is equal to or higher than the threshold value (Pth). The pressure information at the operation port 20*r* has been acquired by the pressure sensor 35. If the pressure (P35) at the operation port 20*r* is equal to or higher than the threshold value (Pth), then the final target flow rate calculating section 38*b*-3 determines that the answer is Yes in step S104, and control goes to step S105. If the pressure (P35) at the operation port 20*r* is lower than the threshold value (Pth), then the final target flow rate calculating section 38*b*-3 determines that the answer is No in step S104, and control goes to step S106.

In step S105, the final target flow rate calculating section 38*b*-3 computes a hypothetical flow rate (Qv) value of a fluid that hypothetically flows through the hypothetical joint line 41 according to a computation process to be described later. After the hypothetical flow rate (Qv) value has been computed, control goes to step S107.

In step S106, the final target flow rate calculating section 38*b*-3 computes a hypothetical flow rate (Qv) value of a fluid that hypothetically flows through the hypothetical joint line 41 as 0. After the hypothetical flow rate (Qv) value has been computed, control goes to step S107.

In step S107, the final target flow rate calculating section 38*b*-3 determines whether or not a value (Q2, org−Qv) obtained by subtracting the hypothetical flow rate (Qv) from the provisional target flow rate (Q2, org) for the second pump 2 is smaller than the minimum flow rate (Q2, min) of the second pump 2. If the value (Q2, org−Qv) is smaller than the minimum flow rate (Q2, min), then the final target flow rate calculating section 38*b*-3 determines that the answer is Yes in step S107, and control goes to step S108. If the value (Q2, org−Qv) is not smaller than the minimum flow rate (Q2, min), then the final target flow rate calculating section 38*b*-3 determines that the answer is No in step S107, and control goes to step S109.

In step S108, the final target flow rate calculating section 38*b*-3 sets the command value output to the regulator 30, i.e., the final target flow rate (Q2, tgt) for the second pump 2, to the minimum flow rate (Q2, min) of the second pump 2. After setting the final target flow rate (Q2, tgt) to the minimum flow rate (Q2, min), the final target flow rate calculating section 38*b*-3 outputs a signal for turning the delivery flow rate of the second pump 2 into the final target flow rate (Q2, tgt) for the second pump 2 to the regulator 30. Then, control goes to step S110.

In step S109, the final target flow rate calculating section 38*b*-3 sets the command value output to the regulator 30, i.e., the final target flow rate (Q2, tgt) for the second pump 2, to the value (Q2, org−Qv) obtained by subtracting the hypothetical flow rate (Qv) from the provisional target flow rate (Q2, org) for the second pump 2. After setting the final target flow rate (Q2, tgt) to the value (Q2, org−Qv), the final target flow rate calculating section 38*b*-3 outputs a signal for turning the delivery flow rate of the second pump 2 into the final target flow rate (Q2, tgt) for the second pump 2 to the regulator 30. Then, control goes to step S110.

In step S110, the final target flow rate calculating section 38*b*-3 determines whether or not a value (Q1, org+Qv) representing the sum of the provisional target flow rate (Q1, org) for the first pump 1 and the hypothetical flow rate (Qv) is larger than the maximum flow rate (Q1, MAX) of the first pump 1. If the value (Q1, org+Qv) is larger than the maximum flow rate (Q1, MAX), then the final target flow rate calculating section 38*b*-3 determines that the answer is Yes in step S110, and control goes to step S111. If the value (Q1, org+Qv) is not larger than the maximum flow rate (Q1, MAX), then the final target flow rate calculating section 38*b*-3 determines that the answer is No in step S110, and control goes to step S112.

In step S111, the final target flow rate calculating section 38*b*-3 sets the command value output to the regulator 29, i.e., the final target flow rate (Q1, tgt) for the first pump 1, to the maximum flow rate (Q1, MAX) of the first pump 1. After setting the final target flow rate (Q1, tgt) to the maximum flow rate (Q1, MAX), the final target flow rate calculating section 38*b*-3 outputs a signal for turning the delivery flow rate of the first pump 1 into the final target flow rate (Q1, tgt) for the first pump 1 to the regulator 29.

In step S112, the final target flow rate calculating section 38*b*-3 sets the command value output to the regulator 29, i.e., the final target flow rate (Q1, tgt) for the first pump 1, to the value (Q1, org+Qv) representing the sum of the provisional target flow rate (Q2, org) for the first pump 1 and the hypothetical flow rate (Qv). After setting the final target flow rate (Q1, tgt) to the value (Q1, org+Qv), the final target flow rate calculating section 38*b*-3 outputs a signal for turning the delivery flow rate of the first pump 1 into the final target flow rate (Q1, tgt) for the first pump 1 to the regulator 29.

The processing sequence for calculating the target flow rate value for the first embodiment has been described above.

Next, a computation formula for computing a flow rate in the hypothetical joint line 41 for the first embodiment will be described below with reference to FIG. 8.

FIG. 8 illustrates a process of computing the hypothetical flow rate (Qv) used in the processing of step S105 illustrated in FIG. 7. According to the present embodiment, a flow rate is computed using an orifice equation. It is assumed that the hypothetical joint line 41 does not cause a pressure loss except in the hypothetical restrictor 40. In this case, an opening degree (Av) in the orifice equation becomes the opening degree (A40) of the hypothetical restrictor 40. This value is received from the constant storage section 38*b*-2 as illustrated in FIG. 5. A pressure difference is a value obtained by subtracting the discharge pressure of the first pump 1 from the discharge pressure of the second pump 2, i.e., a value (P32−P31) obtained by subtracting a value (P31) of the pressure sensor 31 from a value (P32) of the pressure sensor 32. Using other values including the flow rate coefficient (cl) and the density (p) of the hydraulic working fluid that are received from the constant storage section 38*b*-2, the hypothetical flow rate (Qv) can be determined by the equations (1) illustrated in FIG. 8. If the value (P32−P31) obtained by subtracting the value (P31) of the pressure sensor 31 from the value (P32) of the pressure sensor 32 is a negative value, then the hypothetical flow rate (Qv) is 0. The hypothetical flow rate (Qv) in the hypothetical joint line 41 is thus determined by these computations.

Next, operation of the hydraulic excavator 100 for the first embodiment will be described below with reference to FIG. 9.

Figure 9:
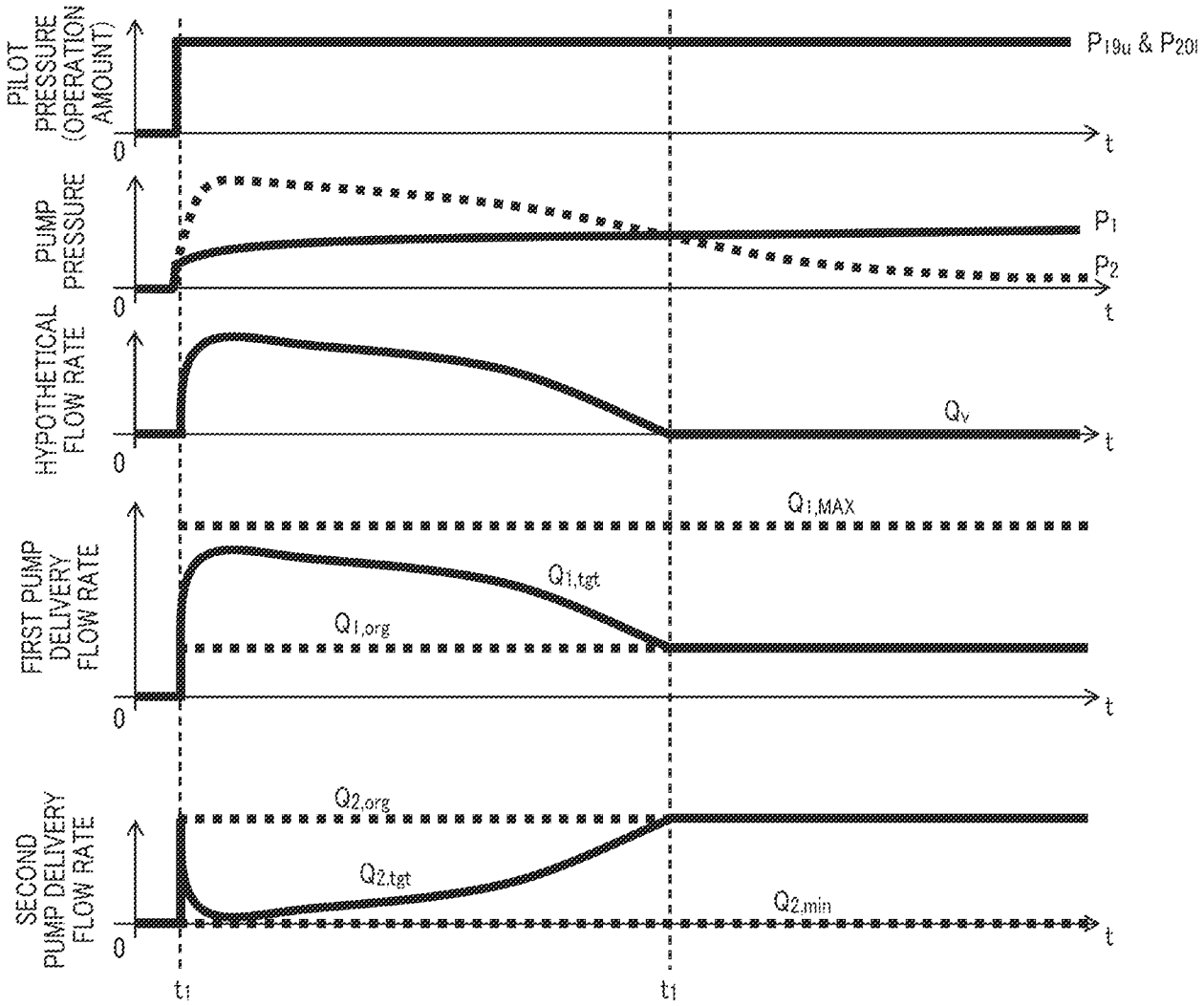
FIG. 9 is a diagram illustrating changes over time in a boom raising pilot pressure, a left swing pilot pressure, discharge pressures from first and second pumps, a hypothetical flow rate, a provisional target flow rate and a final target flow rate for the first pump, and a provisional target flow rate and a final target flow rate for the second pump when the hydraulic excavator for the first embodiment performs swinging/boom raising operation.

FIG. 9 is a diagram illustrating changes over time in a boom raising pilot pressure (P19*u*), a left swing pilot pressure (P201), discharge pressures (P1, P2) from the hydraulic pumps 1 and 2, the hypothetical flow rate (Qv), the provisional target flow rate (Q1, org) and the final target flow rate (Q1, tgt) for the first pump 1, and the provisional target flow rate (Q2, org) and the final target flow rate (Q2, tgt) for the second pump 2 when the hydraulic excavator 100 for the first embodiment performs swinging/boom raising operation.

It is assumed that, at time t1, the pressure (P19*u*) at the operation port 19*u* of the directional control valve 19 and the pressure (P201) at the operation port 201 of the directional control valve 20 rise simultaneously. Since a swinging speed is 0 at this time, the discharge pressure (P2) of the second pump 2 is higher than the discharge pressure (P1) of the hydraulic pump 1. Thereafter, as the swinging speed increases, the discharge pressure (P2) of the second pump 2 drops and becomes lower than the discharge pressure (P1) of the first pump 1 at time t2. Thus, the changes over time in the discharge pressures of the hydraulic pumps 1 and 2 are indicated by a second graph from above in FIG. 9. The solid-line curve in the graph represents the changes over time in the discharge pressure (P1) of the first pump 1, and the broken-line curve in the graph represents the changes over time in the discharge pressure (P2) of the second pump 2.

During this time, the changes over time in the hypothetical flow rate (Qv) are indicated by a third graph from above in FIG. 9. Between time t1 and time t2, since the discharge pressure (P2) of the second pump 2 is higher than the discharge pressure (P1) of the first pump 1, the hypothetical flow rate (Qv) is non-zero. The larger the difference (P2−P1) between the discharge pressure (P2) of the second pump 2 and the discharge pressure (P1) of the first pump 1 is, the larger the hypothetical flow rate (Qv) is, then the hypothetical flow rate (Qv) is a maximum value immediately after t1, and decreases toward time t2. The hypothetical flow rate (Qv) becomes 0 at time t2.

The changes over time in the provisional target flow rate (Q1, org) and the final target flow rate (Q2, tgt) for the first pump 1 are indicated by a second graph from below in FIG. 9. The solid-line curve in the graph represents the changes over time in the final target flow rate (Q2, tgt) for the first pump 1, and the broken-line curve in the graph represents the changes over time in the provisional target flow rate (Q1, org) for the first pump 1. The provisional target flow rate (Q1, org) for the first pump 1 remains to be a constant value at and after time t1, whereas the final target flow rate (Q1, tgt) for the first pump 1 is higher than the provisional target flow rate (Q1, org) for the first pump 1 by the hypothetical flow rate (Qv) between time t1 and time t2.

The changes over time in the provisional target flow rate (Q2, org) and the final target flow rate (Q2, tgt) for the second pump 2 are indicated by a lowest graph in FIG. 9. The solid-line curve in the graph represents the changes over time in the final target flow rate (Q2, tgt) for the second pump 2, and the broken-line curve in the graph represents the changes over time in the provisional target flow rate (Q2, org) for the second pump 2. The provisional target flow rate (Q2, org) for the second pump 2 remains to be a constant value at and after time t1, whereas the final target flow rate (Q2, tgt) for the second pump 2 is lower than the provisional target flow rate (Q2, org) for the second pump 2 by the hypothetical flow rate (Qv) between time t1 and time t2.

According to the present embodiment, the work machine 1 includes the lower track structure 101, the upper swing structure 102 swingably mounted on the lower track structure 101, the work implement 103 including the boom 104 which is angularly movably mounted on the upper swing structure 102, the boom cylinder 17 for driving the boom 104, the swing motor 18 for driving the upper swing structure 102, the boom operation device 21 for operating the boom 104, the swing operation device 22 for operating the upper swing structure 102, the first pump 1 and the second pump 2 as variable-displacement-type hydraulic pumps, the first regulator 29 for controlling the delivery flow rate of the first pump 1, the second regulator 30 for controlling the delivery flow rate of the second pump 2, the boom control valve 19 for controlling a flow of a pressurized fluid supplied from the first pump 1 to the boom cylinder 17, the swing control valve 20 for controlling a flow of a pressurized fluid supplied from the second pump 2 to the swing motor 18, and the controller 38 for controlling the first regulator 29 depending on an operation amount of the boom operation device 21 and controlling the second regulator 30 depending on an operation amount of the swing operation device 22. The controller 38 assumes that the line 7 for supplying a pressurized fluid from the first pump 1 to the bottom-side chamber 17B of the boom cylinder 17 and the second pump 2 are interconnected by the hypothetical joint line 41, computes the hypothetical flow rate (Qv) representing a flow rate in the hypothetical joint line 41, computes the first pump provisional target flow rate (Q1, org) representing a provisional target flow rate for the first pump 1 on the basis of the operation amount of the boom operation device 21, computes the second pump provisional target flow rate (Q2, org) representing a provisional target flow rate for the second pump 2 on the basis of the operation amount of the swing operation device 22, computes the first pump final target flow rate (Q1, tgt) representing a final target flow rate for the first pump 1 by adding the hypothetical flow rate (Qv) to the first pump provisional target flow rate (Q1, org), and computes the second pump final target flow rate (Q2, tgt) representing a final target flow rate for the second pump 2 by subtracting the hypothetical flow rate (Qv) from the second pump provisional target flow rate (Q2, org).

According to the first embodiment arranged as described above, as the work machine has no joint line for supplying the pressurized fluid from the second pump 2 to the bottom-side chamber 17B of the boom cylinder 17, the work machine is able to reduce a pressure loss due to a shunt compared with work machines that have such a joint line. Moreover, since the delivery flow rate of the first pump 1 is increased from the provisional target flow rate (Q1, org) by the hypothetical flow rate (Qv) during swinging/boom raising operation, the work machine can achieve operability equivalent to that of the work machines that have the joint line. Furthermore, since the delivery flow rate of the second pump 2 is reduced from the provisional target flow rate (Q2, org) by the hypothetical flow rate (Qv) during swinging/boom raising operation, the work machine can achieve energy saving ability equivalent to that of the work machines that have the joint line.

In addition, the controller 38 stores the minimum flow rate (Q2, min) of the second pump 2, and uses the minimum flow rate (Q2, min) as the final target flow rate (Q2, tgt) for the second pump 2 if the final target flow rate (Q2, tgt) for the second pump 2 is smaller than the minimum flow rate (Q2, min) of the second pump 2. Consequently, the final target flow rate (Q2, tgt) for the second pump 2 is prevented from becoming smaller than the maximum flow rate (Q1, min).

In addition, the controller 38 stores the maximum flow rate (Q1, MAX) of the first pump 1, and uses the maximum flow rate (Q1, MAX) as the final target flow rate (Q1, tgt) for the first pump 1 if the final target flow rate (Q1, tgt) for the first pump 1 is larger than the maximum flow rate (Q1, MAX) of the first pump 1. Consequently, the final target flow rate (Q1, tgt) for the first pump 1 is prevented from becoming larger than the maximum flow rate (Q1, MAX).

Either one of the hypothetical restrictor 40 and the hypothetical check valve 39 may be positioned upstream of the other. According to the present embodiment, the orifice equation is used by the process of computing the hypothetical flow rate. However, the hypothetical flow rate may be determined by another process using a choke equation, a table for outputting a flow rate in response to a pressure difference input thereto, or the like. In this case, a value of a constant required by the computation in step S105 illustrated in FIG. 7 is transmitted from the constant storage section 38*b*-2 to the final target flow rate calculating section 38*b*-3, and the process of computing the flow rate used in the processing of step S105 is replaced with the choke equation, the table, or the like. Moreover, the provisional target flow rate calculating section 38*b*-1 may calculate a provisional target flow rate by using a value from the pressure sensor 31, a value from the pressure sensor 32, or an output value from a sensor, not shown.

Second Embodiment

A second embodiment of the present invention will be described below with reference to FIGS. 10 through 15. The components that are identical to those for the first embodiment will be omitted from description.

Figure 10:
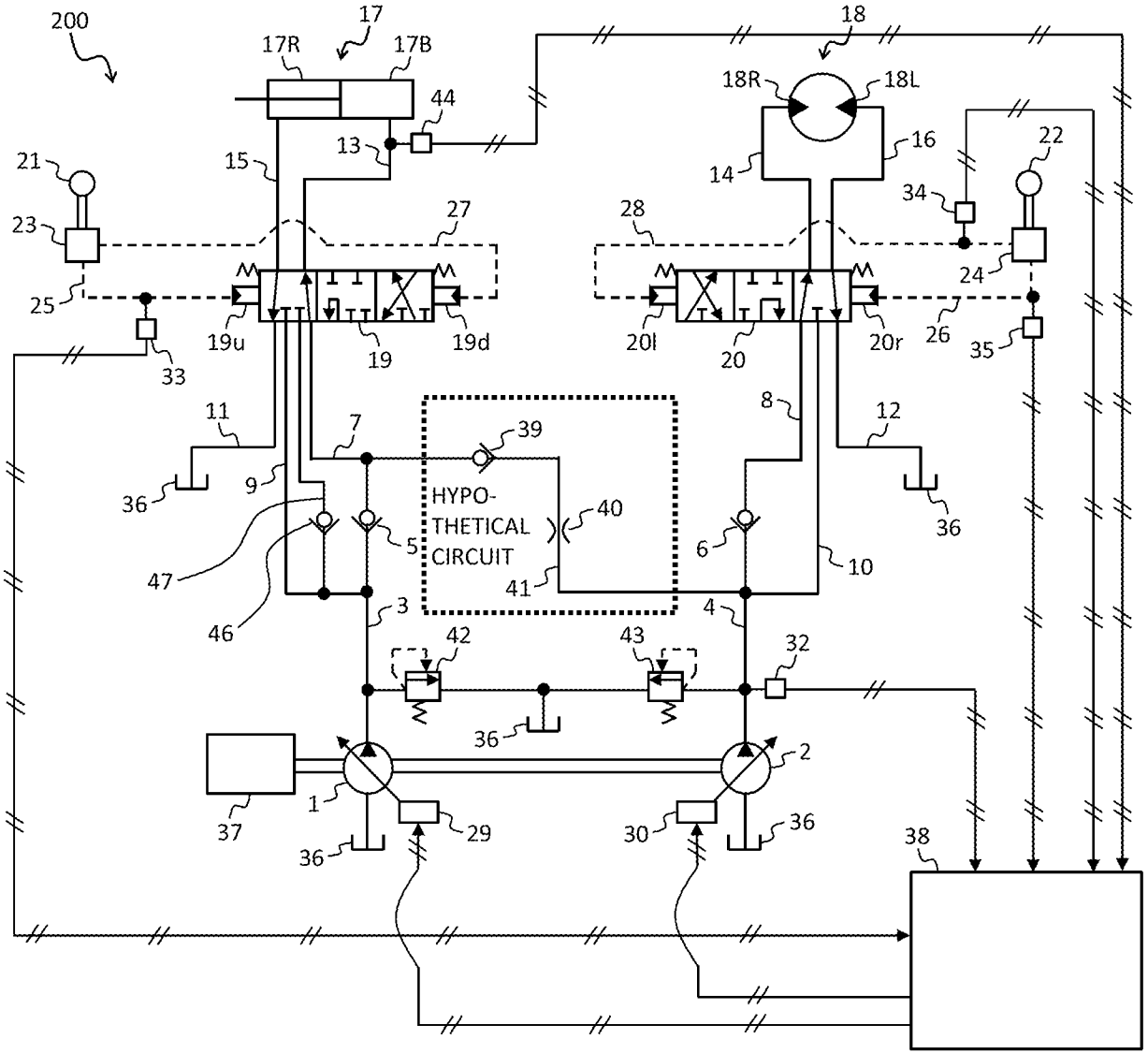
FIG. 10 is a diagram illustrating an arrangement of a hydraulic control system including a hypothetical circuit for a second embodiment.

An arrangement including a hypothetical circuit for the second embodiment will be described below with reference to FIG. 10.

The second embodiment is different from the first embodiment (illustrated in FIG. 2) in that a pressure sensor 44 is attached to the boom bottom line 13, instead of the pressure sensor 31 attached to the line 3. The pressure sensor 44 is electrically connected to the controller 38.

Figure 11:
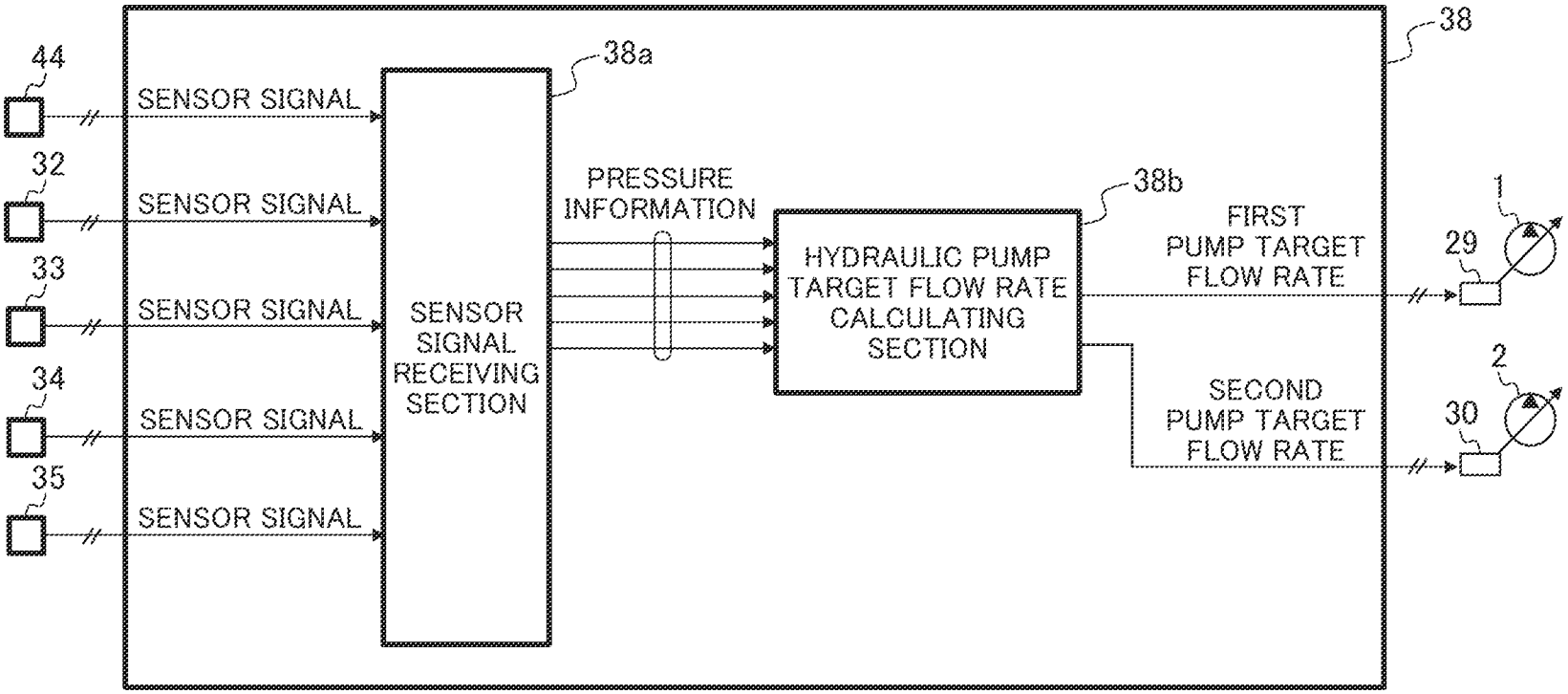
FIG. 11 is a diagram illustrating functions of a controller for the second embodiment.

Next, functions of the controller 38 for the second embodiment will be described below with reference to FIG. 11.

The controller 38 is different from the controller 38 for the first embodiment (illustrated in FIG. 4) in that a sensor signal is transmitted from the pressure sensor 44, rather than the pressure sensor 31, to the sensor signal receiving section 38*a*. The sensor signal receiving section 38*a* converts the signals sent from the pressure sensors 32 through 35 and 44 into pressure information and transmits the pressure information to the hydraulic pump target flow rate calculating section 38*b*.

Figure 12:
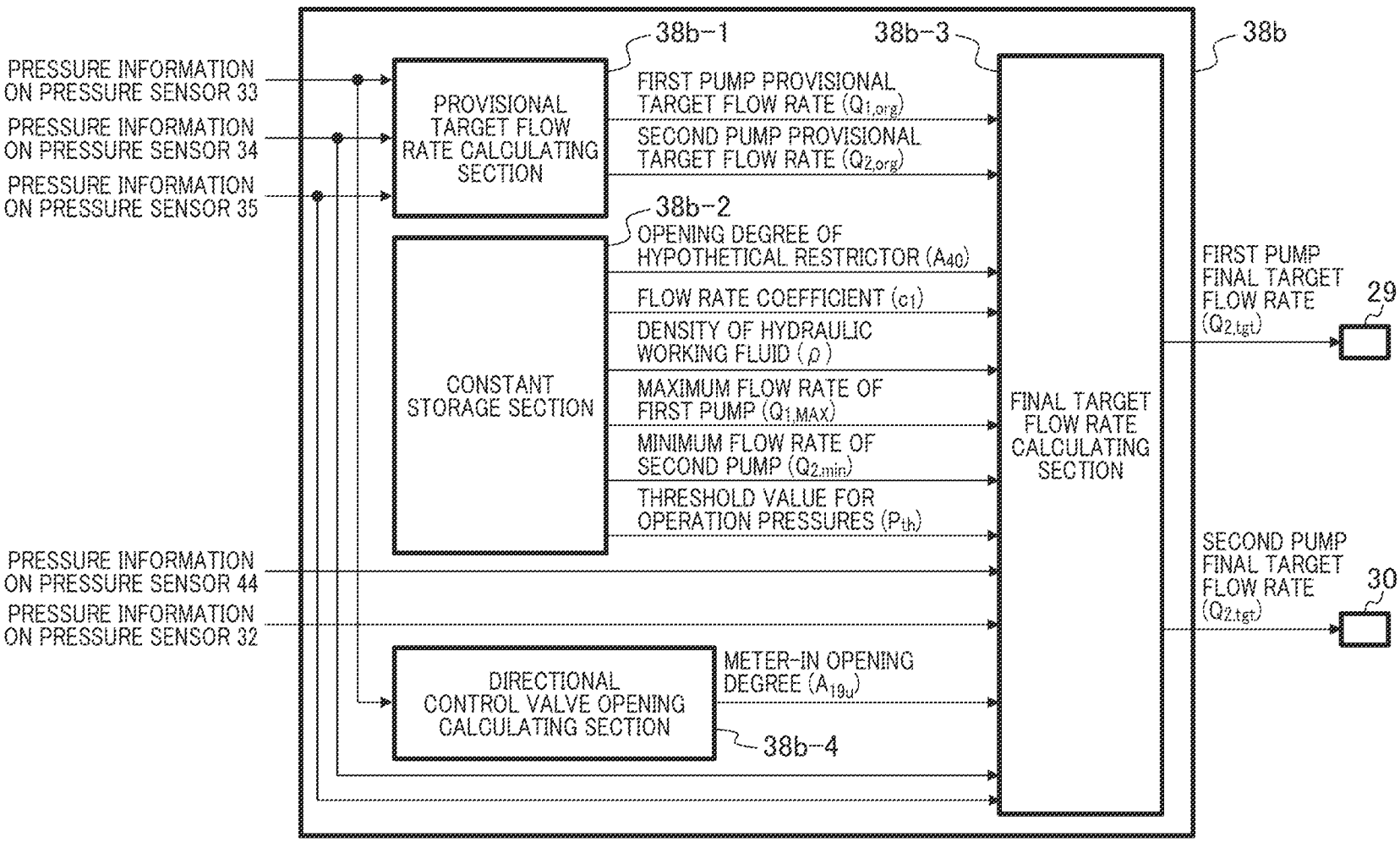
FIG. 12 is a diagram illustrating functions of a hydraulic pump target flow rate calculating section for the second embodiment.

Next, functions of the hydraulic pump target flow rate calculating section 38*b* for the second embodiment will be described below with reference to FIGS. 12 and 13.

The hydraulic pump target flow rate calculating section 38*b* is different from the hydraulic pump target flow rate calculating section 38*b* for the first embodiment (illustrated in FIG. 5) in that the final target flow rate calculating section 38*b*-3 receives the pressure information on the pressure sensor 44 instead of the pressure information on the pressure sensor 31, and also in that the hydraulic pump target flow rate calculating section 38*b* has a directional control valve opening calculating section 38*b*-4 for calculating an opening degree (A19*u*) of a hydraulic fluid line in the directional control valve 19 that interconnects the line 7 and the boom bottom line 13. The directional control valve opening calculating section 38*b*-4 is supplied with the pressure information input from the pressure sensor 33 and outputs the opening degree (A19*u*) of the hydraulic fluid line in the directional control valve 19 that interconnects the line 7 and the boom bottom line 13. The hydraulic pump target flow rate calculating section 38*b* is also different from the hydraulic pump target flow rate calculating section 38*b* for the first embodiment in that the final target flow rate calculating section 38*b*-3 receives information on the opening degree (A19*u*) of the hydraulic fluid line in the directional control valve 19 that interconnects the line 7 and the boom bottom line 13, rather than the pressure information on the pressure sensor 33.

Figure 13:
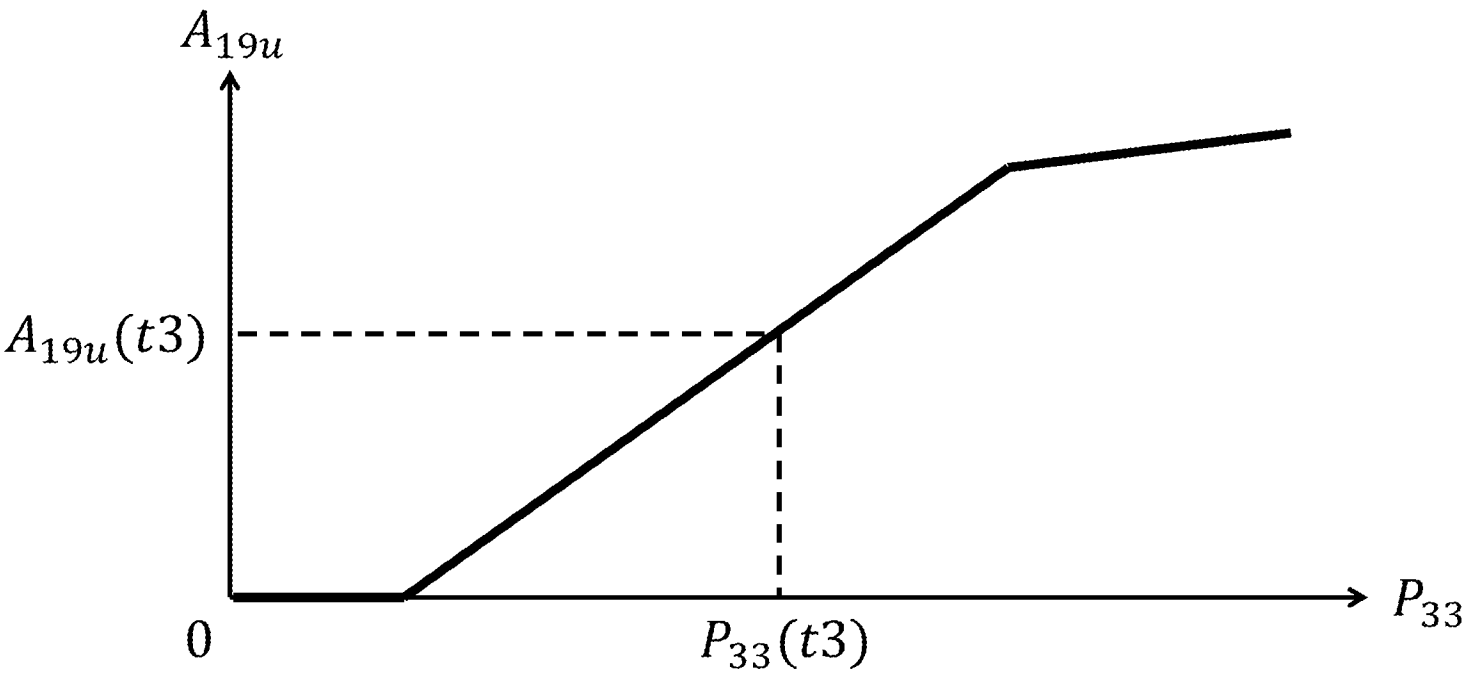
FIG. 13 is a diagram illustrating a process of calculating an opening degree of a directional control valve for the second embodiment.

The directional control valve opening calculating section 38*b*-4 determines the opening degree (A19*u*) by using a table illustrated in FIG. 13. For example, if the pressure of the pressure sensor 33 is a value P33(*t*3) at time t3, then the directional control valve opening calculating section 38*b*-4 outputs a value A19*u*(t3).

Next, a processing sequence for calculating a target flow rate value for the second embodiment will be described below with reference to FIG. 14.

The processing sequence is different from the processing sequence for the first embodiment (illustrated in FIG. 7) in that step S102 is deleted and step S105 is replaced with step S113 and step S114.

In step S113, a combined opening degree (Av) representing a combination of the opening degree (A40) of the hypothetical restrictor 40 and the opening degree (A19*u*) of the hydraulic fluid line in the directional control valve 19 that interconnects the line 7 and the boom bottom line 13 is computed according to a computing process to be described later. After the combined opening degree (Av) has been computed, control goes to step S114.

In step S114, the value of the hypothetical flow rate (Qv) of the fluid that flows hypothetically in the hypothetical joint line 41 is computed according to a computing process to be described later. After the value of the hypothetical flow rate (Qv) has been computed, control goes to step S107. Thereafter, the same processing as with the first embodiment is carried out.

Next, a computation formula for computing the combined opening degree (Av) and a computation formula for computing the flow rate in the hypothetical joint line 41 for the second embodiment will be described below with reference to FIG. 15.

Figure 14:
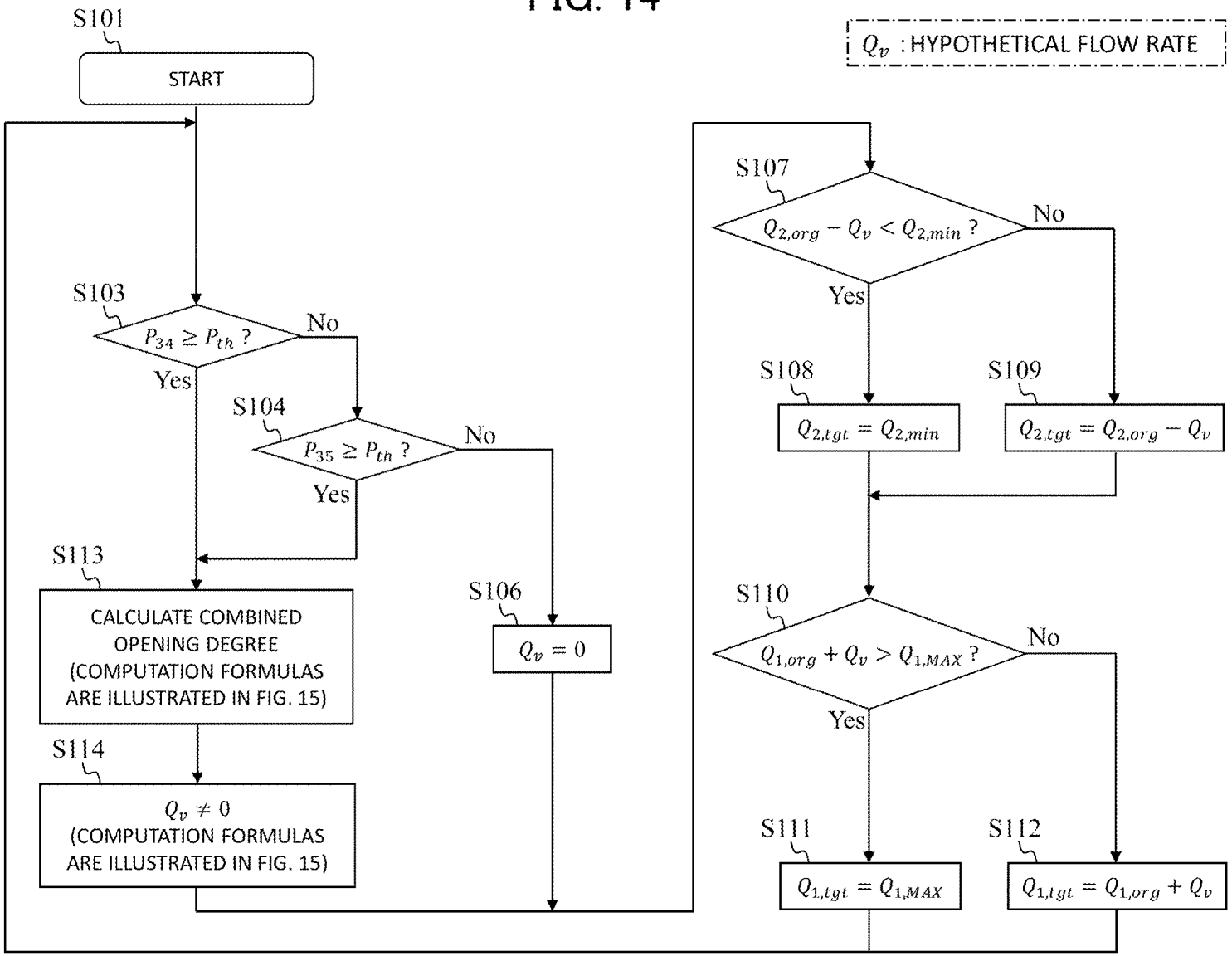
FIG. 14 is a flowchart of a processing sequence for calculating a target flow rate value for the second embodiment.

An equation (2) illustrated in FIG. 15 represents the process of computing the combined opening degree (Av) that is used in the processing of step S113 illustrated in FIG. 14. It is assumed that the hypothetical joint line 41 does not cause a pressure loss except in the hypothetical restrictor 40. In this case, the opening degrees to be combined are the opening degree (A40) of the hypothetical restrictor 40 and the opening degree (A19*u*) of the hydraulic fluid line in the directional control valve 19 that interconnects the line 7 and the boom bottom line 13.

Equations (3) illustrated in FIG. 15 represent the process of computing the hypothetical flow rate (Qv) that is used in the processing of step S114 illustrated in FIG. 14. For the present embodiment, the hypothetical flow rate (Qv) is computed using an orifice equation. The equations are different from those for the first embodiment in that the value (P44) of the pressure sensor 44 is used instead of the value (P32) of the pressure sensor 31. The computing process can compute the hypothetical flow rate (Qv) of a fluid that flows through the hypothetical joint line 41 and the directional control valve 19 into the boom bottom line 13.

The work machine 1 for the present embodiment further includes the second pump pressure sensor 32 for detecting the second pump discharge pressure (P32) as a discharge pressure of the second pump 2, and the boom bottom pressure sensor 44 for detecting the boom bottom pressure (P44) as a pressure in the bottom-side chamber 17B of the boom cylinder 17. The controller 38 assumes that the hypothetical joint line 41 has an end connected to the second pump 2 and the other end connected to the first pump 1, computes the opening degree (A19*u*) of the boom control valve 19 on the basis of an operation amount of the boom operation device 21, computes the combined opening degree (Av) representing a combination of the opening degree (A19*u*) of the boom control valve 19 and the opening degree (A40) of the hypothetical restrictor 40, and computes the hypothetical flow rate (Qv) on the basis of the second pump discharge pressure (P32), the boom bottom pressure (P44), and the combined opening degree (Av).

The second embodiment arranged as described above offers the advantages similar to those for the first embodiment.

Third Embodiment

A third embodiment of the present invention will be described below with reference to FIGS. 16 through 20. Since the present embodiment is based on the second embodiment, the components that are identical to those for the second embodiment will be omitted from description.

Figure 16:
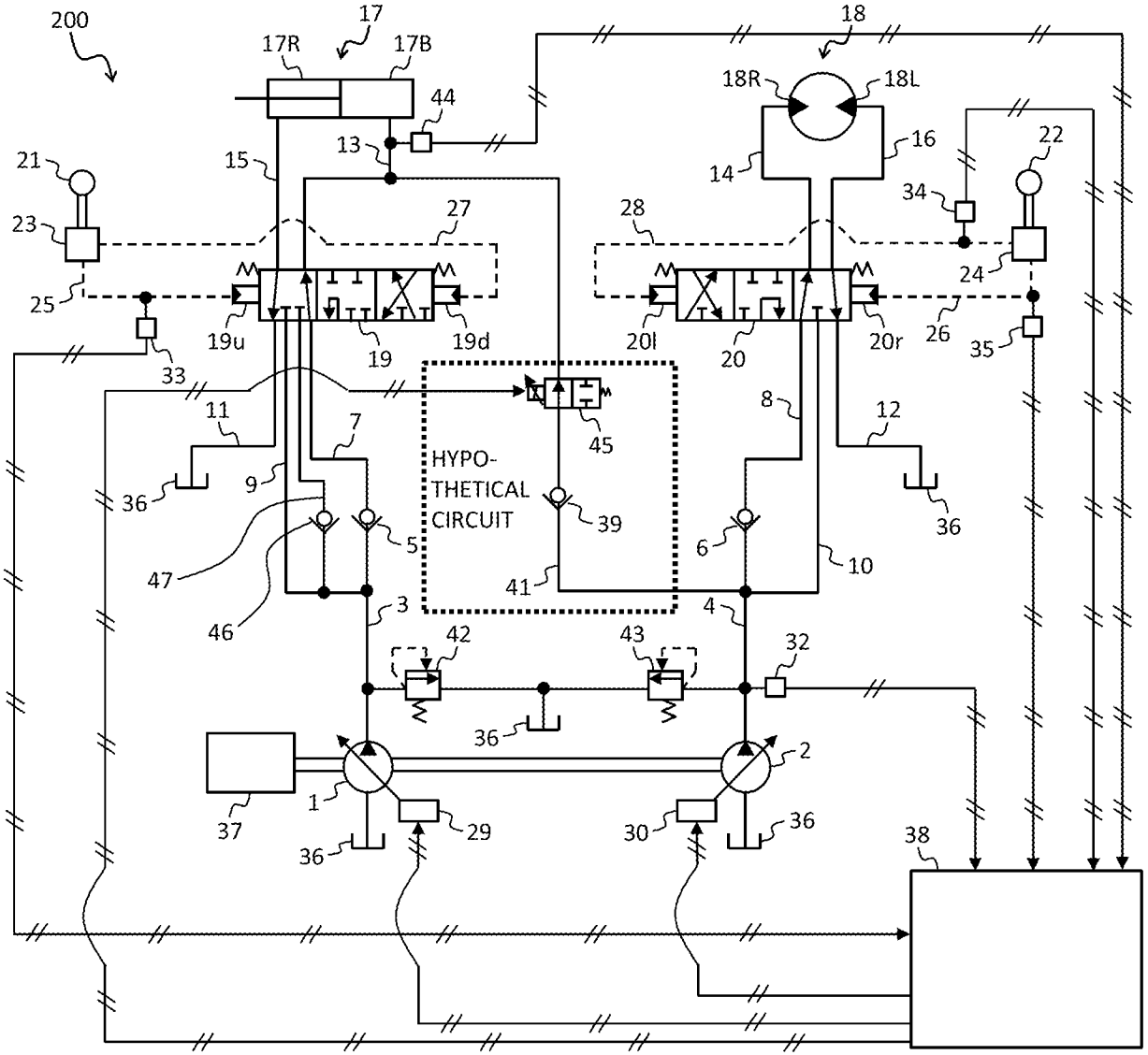
FIG. 16 is a diagram illustrating an arrangement of a hydraulic control system including a hypothetical circuit for a third embodiment.

An arrangement including a hypothetical circuit for the third embodiment will be described below with reference to FIG. 16.

The third embodiment is different from the second embodiment (illustrated in FIG. 10) in that the hypothetical joint line 41 is connected on its downstream side to a freely-selected point on the boom bottom line 13, and also in that a hypothetical flow rate control valve 45, rather than the hypothetical restrictor 40, is provided in the hypothetical joint line 41. It is assumed that the hypothetical flow rate control valve 45 is hypothetically electrically connected to the controller 38. The hypothetical joint line 41, the hypothetical check valve 39, and the hypothetical flow rate control valve 45 make up the hypothetical circuit for the present embodiment.

Figure 17:
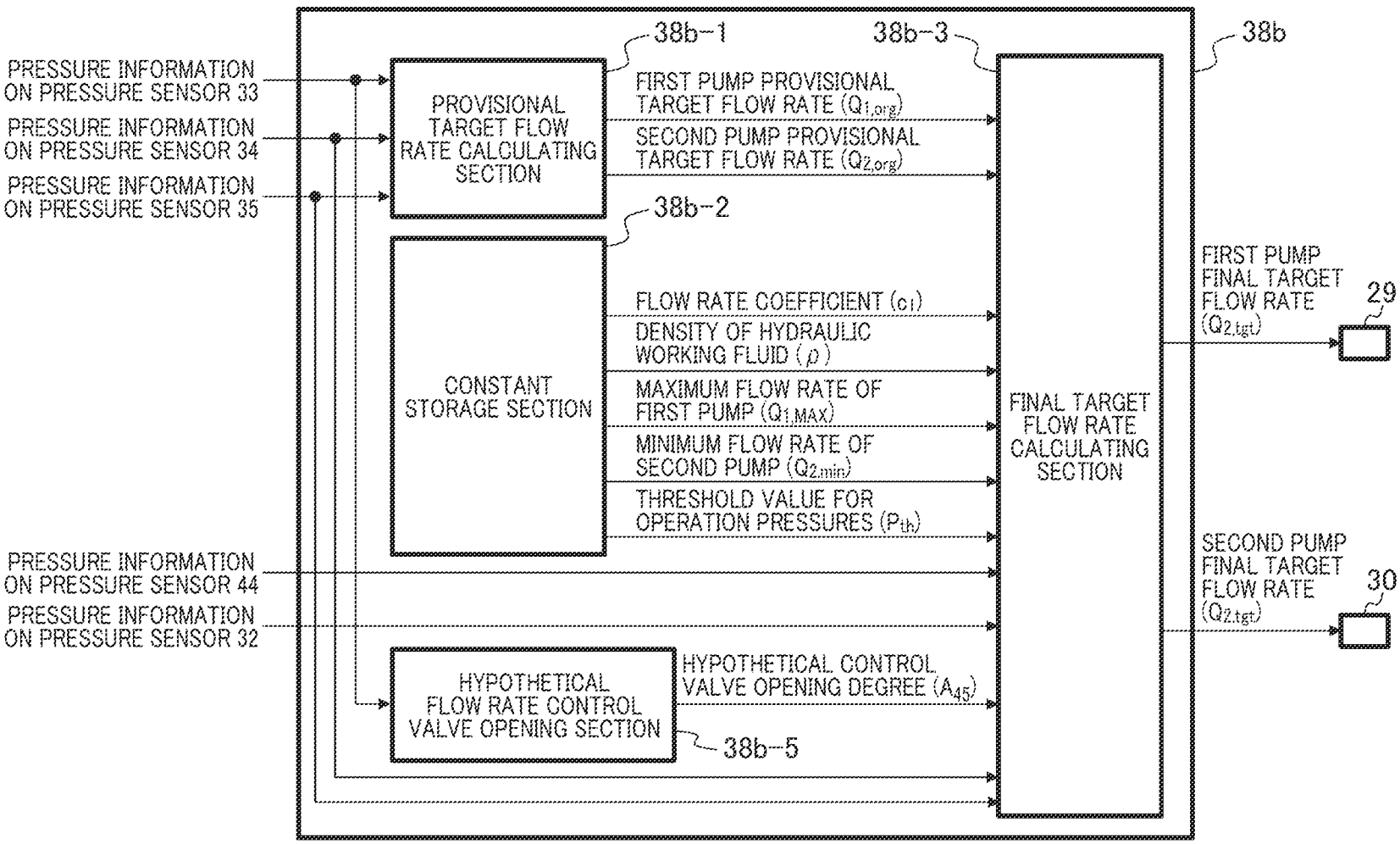
FIG. 17 is a diagram illustrating functions of a hydraulic pump target flow rate calculating section for the third embodiment.

Next, functions of the hydraulic pump target flow rate calculating section 38*b* for the third embodiment will be described below with reference to FIGS. 17 and 18.

The hydraulic pump target flow rate calculating section 38*b* for the third embodiment is different from the hydraulic pump target flow rate calculating section 38*b* for the second embodiment (illustrated in FIG. 12) in that, of the information on the constants transmitted from the constant storage section 38*b*-2 to the final target flow rate calculating section 38*b*-3, the information on the opening degree (A40) of the hypothetical restrictor 40 is not transmitted, and also in that the hydraulic pump target flow rate calculating section 38*b* has a hypothetical flow rate control valve opening calculating section 38*b*-5 for calculating an opening degree (A45) of the hypothetical flow rate control valve 45, instead of the directional control valve opening calculating section 38*b*-4. The hypothetical flow rate control valve opening calculating section 38*b*-5 is supplied with the pressure information input from the pressure sensor 33 and outputs the opening degree (A45) of the hypothetical flow rate control valve 45. The hydraulic pump target flow rate calculating section 38*b* for the third embodiment is also different from the hydraulic pump target flow rate calculating section 38*b* for the second embodiment in that the final target flow rate calculating section 38*b*-3 receives the information on the opening degree (A45) of the hypothetical flow rate control valve 45, instead of the information on the opening degree (A19*u*) of the hydraulic fluid line in the directional control valve 19 that interconnects the line 7 and the boom bottom line 13.

Figure 18:
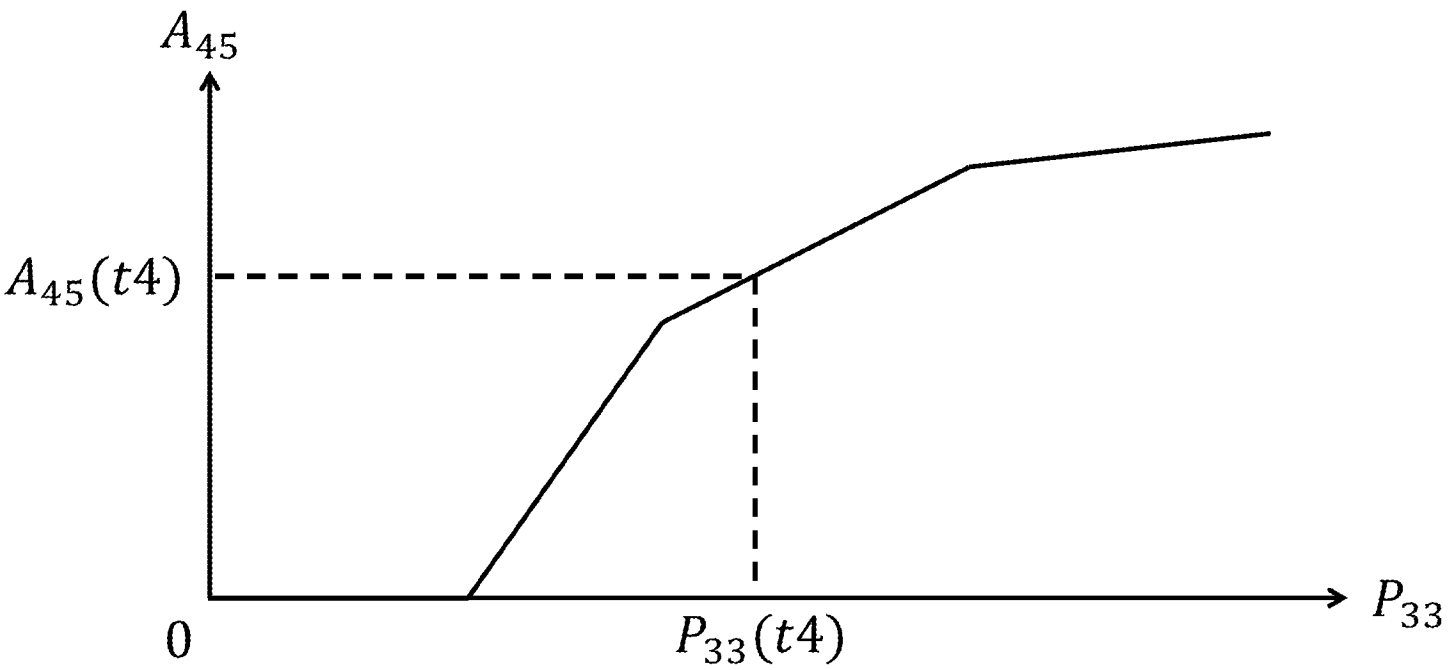
FIG. 18 is a diagram illustrating a process of calculating an opening degree of a hypothetical flow rate control valve for the third embodiment.

The hypothetical flow rate control valve opening calculating section 38*b*-5 determines the opening degree (A45) by using a table illustrated in FIG. 18. For example, if the pressure of the pressure sensor 33 is a value P33(*t*4) at time t4, then the hypothetical flow rate control valve opening calculating section 38*b*-5 outputs a value A45(*t*4).

Figure 19:
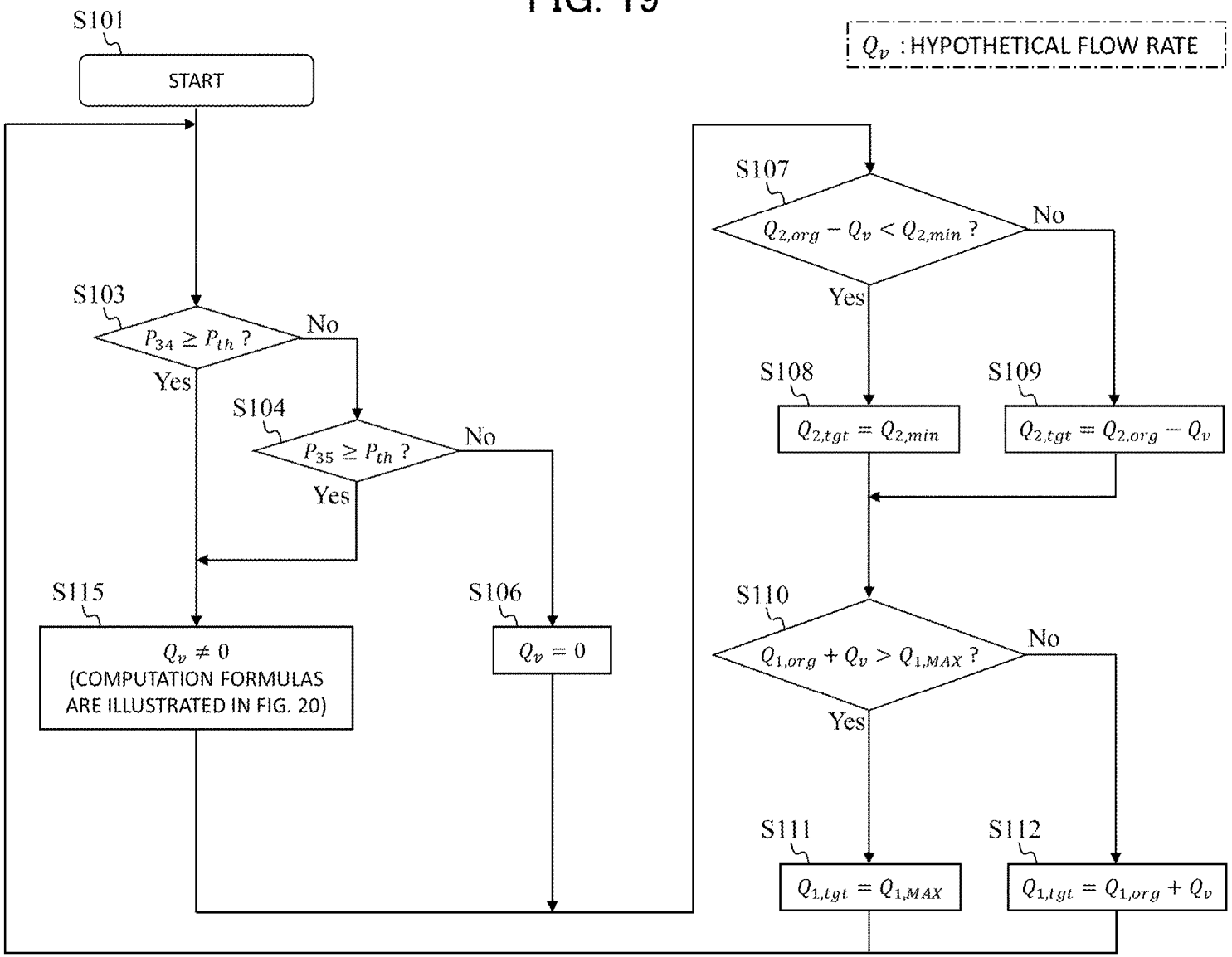
FIG. 19 is a flowchart of a processing sequence for calculating a target flow rate value for the third embodiment.

Next, a processing sequence for calculating a target flow rate value for the third embodiment will be described below with reference to FIG. 19.

The processing sequence is different from the processing sequence for the second embodiment (illustrated in FIG. 14) in that step S113 and step S114 are replaced with step S115.

In step S115, the value of the hypothetical flow rate (Qv) of the fluid that flows hypothetically in the hypothetical joint line 41 is computed according to a computing process to be described later. After the value of the hypothetical flow rate (Qv) has been computed, control goes to step S107. Thereafter, the same processing as with the first embodiment and the second embodiment is carried out.

Next, a computation formula for computing the flow rate in the hypothetical joint line 41 for the third embodiment will be described below with reference to FIG. 20.

The computation formula is different from that for the second embodiment in that the computation of the combined opening degree is eliminated and the computation formula is close to the computation formula for the first embodiment (illustrated in FIG. 8). However, the computation formula is different from that for the first embodiment in that the opening degree (A45) of the hypothetical flow rate control valve 45 is used instead of the opening degree (A40) of the hypothetical restrictor 40 and that the value (P44) of the pressure sensor 44 is used instead of the value (P32) of the pressure sensor 31. The computing process can compute the hypothetical flow rate (Qv) of a fluid that flows through the hypothetical joint line 41 into the boom bottom line 13.

The work machine 1 for the present embodiment further includes the second pump pressure sensor 32 for detecting the second pump pressure (P32) as a discharge pressure of the second pump 2, and the boom bottom pressure sensor 44 for detecting the boom bottom pressure (P44) representing a pressure in the bottom-side chamber 17B of the boom cylinder 17. The controller 38 assumes that the hypothetical joint line 41 has an end connected to the second pump 2 and the other end connected to the boom bottom line 13 that interconnects the bottom-side chamber 17B of the boom cylinder 17 and the boom control valve 19, with the hypothetical flow rate control valve 45 provided in the hypothetical joint line 41, computes the opening degree (A45) of the hypothetical flow rate control valve 45 on the basis of an operation amount of the boom operation device 21, and computes the hypothetical flow rate (Qv) on the basis of the second pump pressure (P32), the boom bottom pressure (P44), and the opening degree (A45) of the hypothetical flow rate control valve 45.

The third embodiment arranged as described above offers the advantages similar to those for the first embodiment.

Furthermore, when the value of the pressure sensor 33 is small, for example, the hypothetical flow rate (Qv) can have its characteristics determined in a desired manner, e.g., can be set to 0 by setting the opening degree (A45) of the hypothetical flow rate control valve 45 to 0.

Either one of the hypothetical flow rate control valve 45 and the hypothetical check valve 39 may be positioned upstream of the other. According to the present embodiment, only the pressure information on the pressure sensor 33 is input to the hypothetical flow rate control valve opening calculating section 38*b*-5. However, the hypothetical flow rate control valve opening calculating section 38*b*-5 may compute the opening degree (A45) of the hypothetical flow rate control valve 45 on the basis of pressure information from other pressure sensors. Moreover, the hypothetical joint line 41 may be connected on its downstream side to a point at the same position as with the first embodiment.

Fourth Embodiment

A fourth embodiment of the present invention will be described below with reference to FIGS. 21 through 24. Since the present embodiment is based on the first embodiment, the components that are identical to those for the first embodiment will be omitted from description.

Figure 21:
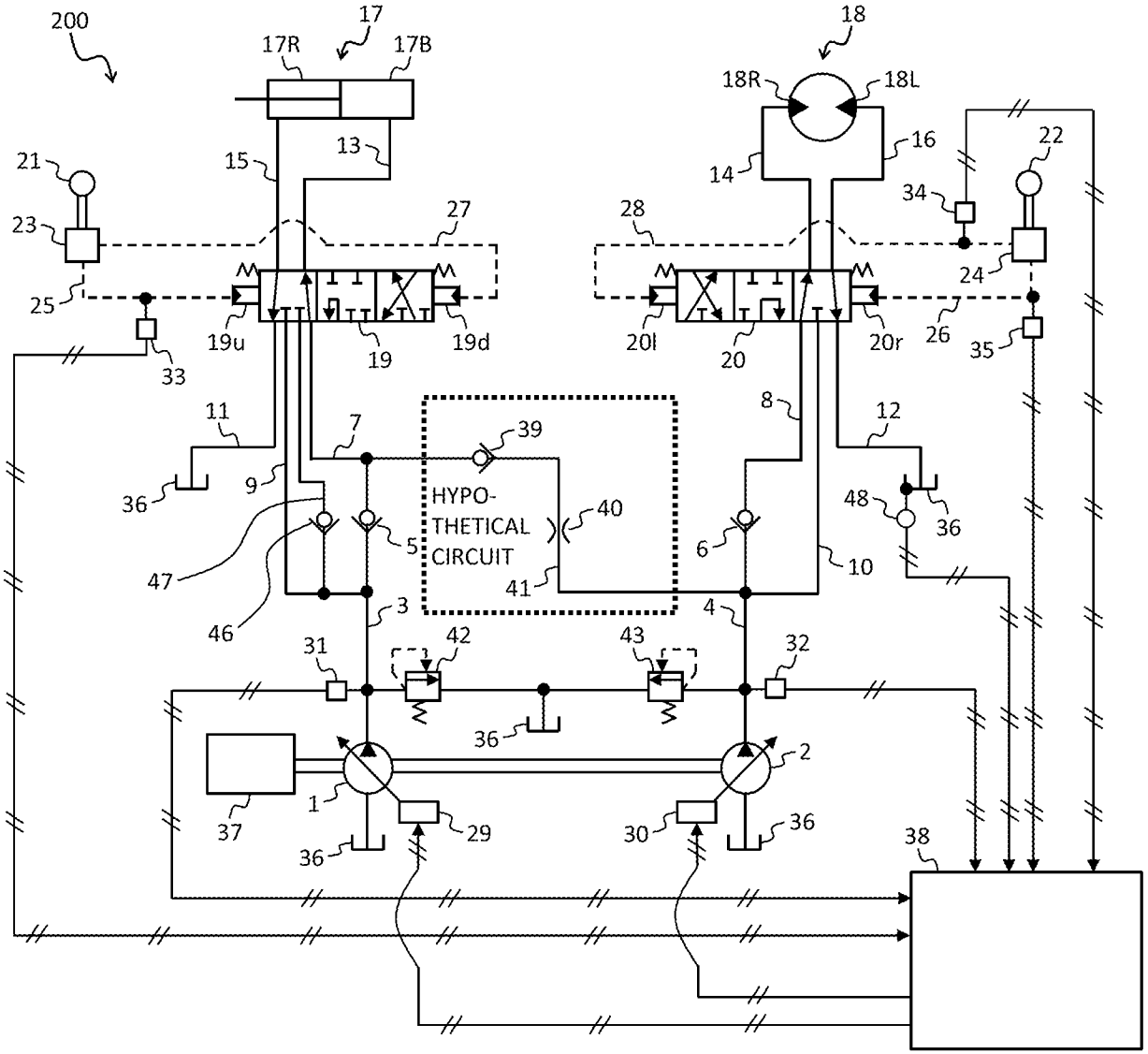
FIG. 21 is a diagram illustrating an arrangement of a hydraulic control system including a hypothetical circuit for a fourth embodiment.

An arrangement of the hydraulic control system 200 that includes a hypothetical circuit for the fourth embodiment will be described below with reference to FIG. 21.

The hydraulic control system 200 for the fourth embodiment is different from that for the first embodiment (illustrated in FIG. 3) in that a temperature sensor 48 for measuring a temperature of the hydraulic working fluid is attached to the tank 36. The temperature sensor 48 is electrically connected to the controller 38.

Figure 22:
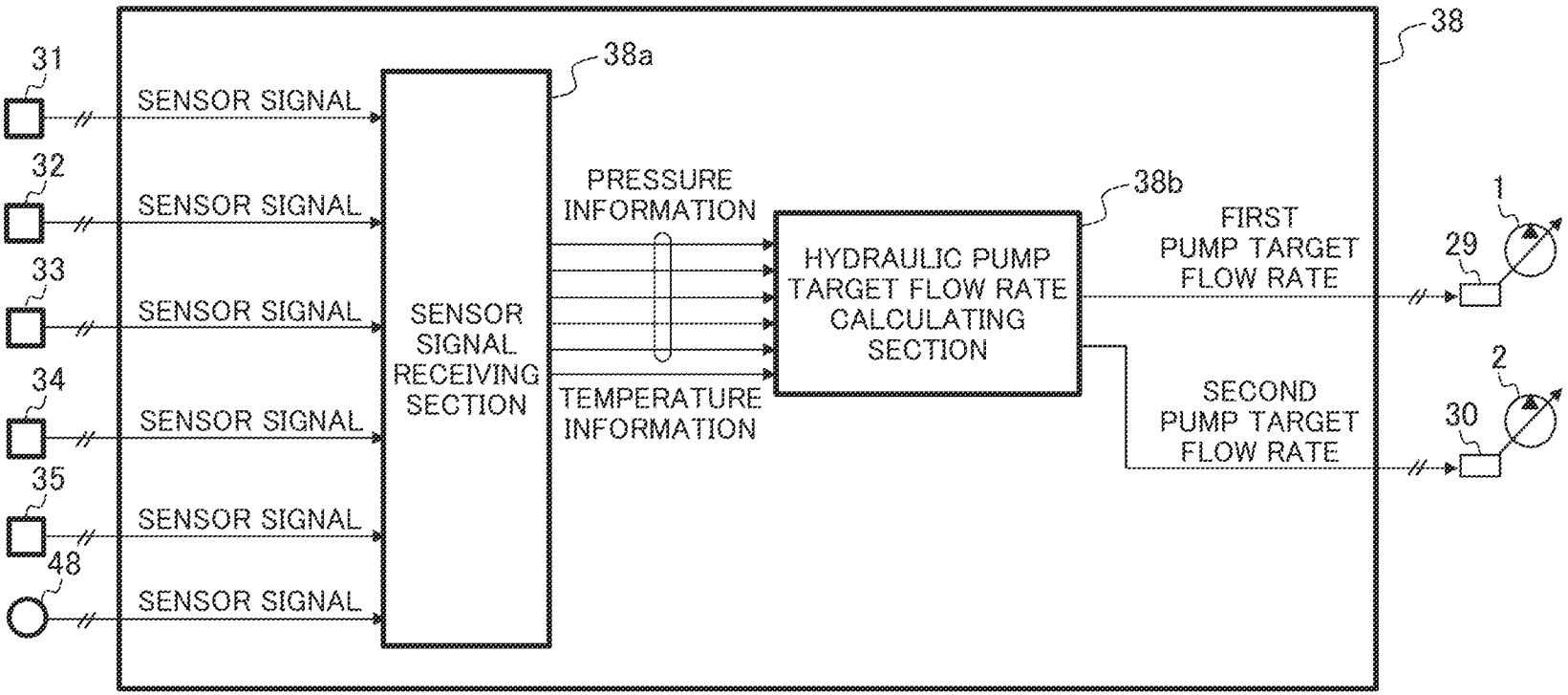
FIG. 22 is a diagram illustrating functions of a controller for the fourth embodiment.
Figure 23:
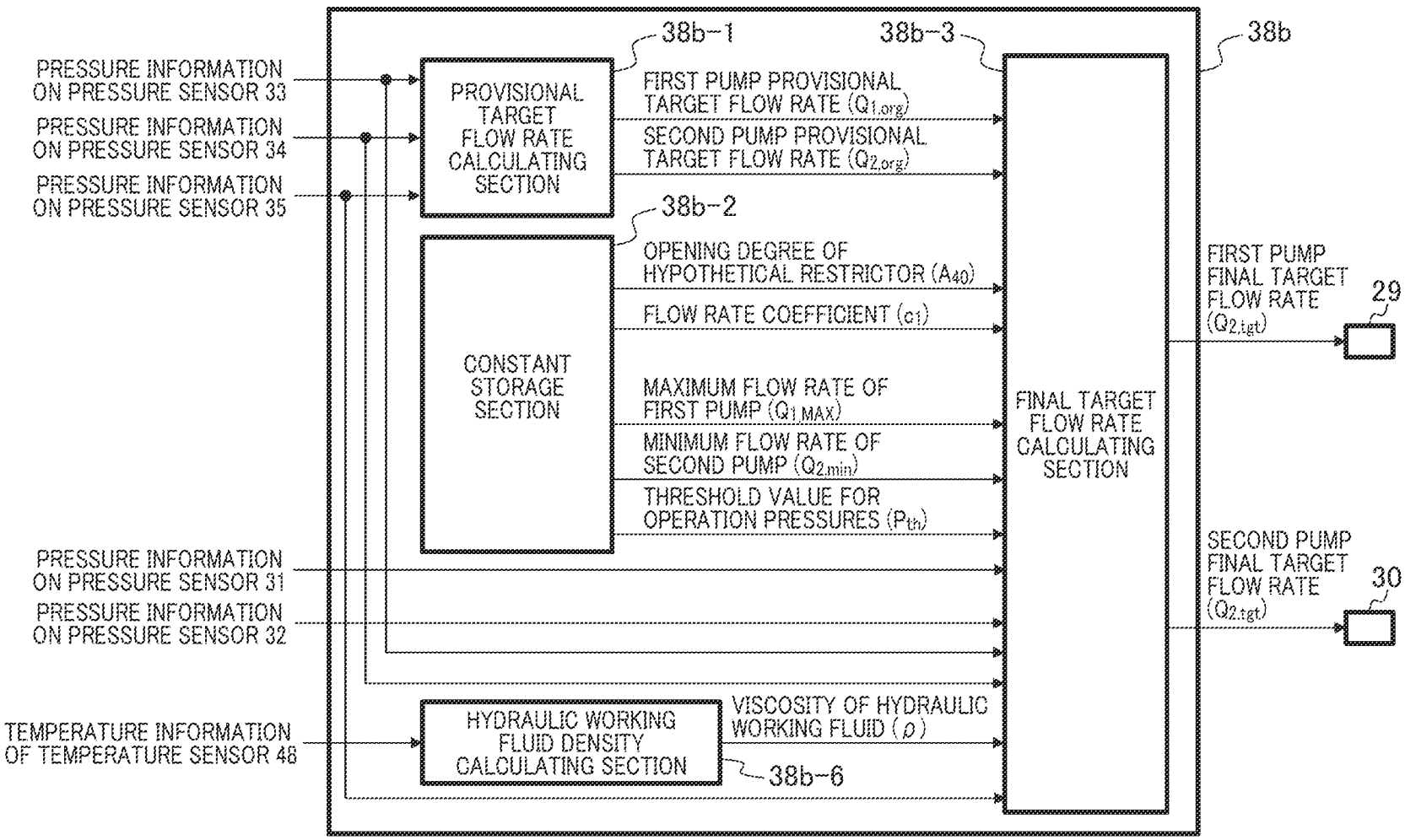
FIG. 23 is a diagram illustrating functions of a hydraulic pump target flow rate calculating section for the fourth embodiment.

Functions of the controller 38 and functions of the hydraulic pump target flow rate calculating section 38*b* for the fourth embodiment will be described below with reference to FIGS. 22 through 24.

The functions of the controller 38 for the fourth embodiment are different from the functions (illustrated in FIG. 4) of the controller 38 for the first embodiment in that the sensor signal receiving section 38*a* receives a signal from the temperature sensor 48, converts the signal into temperature information on the hydraulic working fluid, and transmits the temperature information to the hydraulic pump target flow rate calculating section 38*b*.

The functions of the hydraulic pump target flow rate calculating section 38*b* for the fourth embodiment are different from the functions (illustrated in FIG. 5) of the hydraulic pump target flow rate calculating section 38*b* for the first embodiment in that, of the information on the constants transmitted from the constant storage section 38*b*-2 to the final target flow rate calculating section 38*b*-3, the information on the density (p) of the hydraulic working fluid is not transmitted, and that the hydraulic pump target flow rate calculating section 38*b* has a hydraulic working fluid density calculating section 38*b*-6 for calculating a density of the hydraulic working fluid. The hydraulic working fluid density calculating section 38*b*-6 is supplied with the temperature information input from the temperature sensor 48 and outputs the density (p) of the hydraulic working fluid. The final target flow rate calculating section 38*b*-3 receives the information on the density (p) of the hydraulic working fluid from the hydraulic working fluid density calculating section 38*b*-6, not from the constant storage section 38*b*-2.

Figure 24:
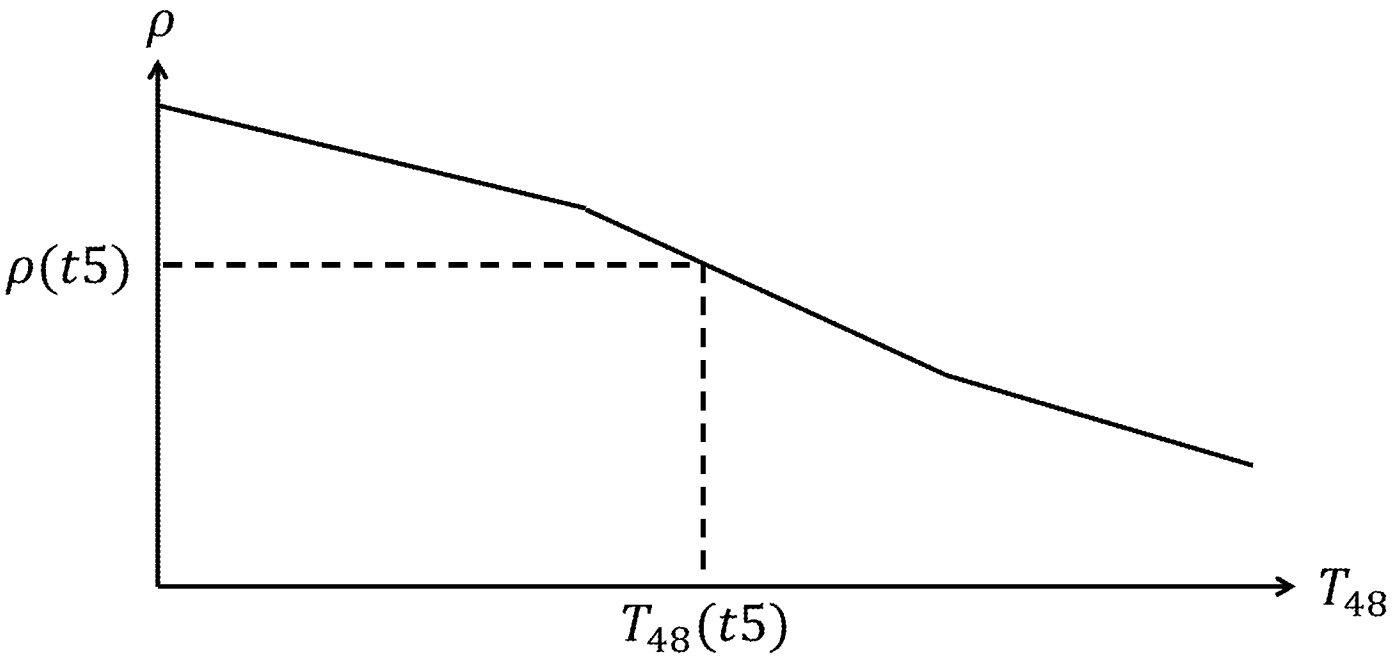
FIG. 24 is a diagram illustrating a process of calculating a density of a hydraulic working fluid for the fourth embodiment.

The hydraulic working fluid density calculating section 38*b*-6 determines the density (p) of the hydraulic working fluid by using a table illustrated in FIG. 24. For example, if the temperature from the temperature sensor 48 is a value T48(*t*5) at time t5, then the hydraulic working fluid density calculating section 38*b*-6 outputs a value p(t5).

The work machine 100 for the present embodiment further includes the temperature sensor 48 for detecting the temperature of the hydraulic working fluid. The controller 38 computes the density (p) of the hydraulic working fluid based on the temperature of the hydraulic working fluid detected by the temperature sensor 48 and computes the hypothetical flow rate (Qv) on the basis of the first pump discharge pressure (P31), the second pump discharge pressure (P32), the opening degree of the hypothetical restrictor 40, and the density (p) of the hydraulic working fluid.

The fourth embodiment of the present invention thus arranged is capable of realizing operability and energy saving ability that are equivalent to those of work machines that have a joint line to be used during swinging/boom raising operation, taking into account effects due to changes in the density of the hydraulic working fluid, without incorporating a joint line for supplying a pressurized fluid from the second pump 2 to the bottom-side chamber 17B of the boom cylinder 17.

Fifth Embodiment

Figure 25:
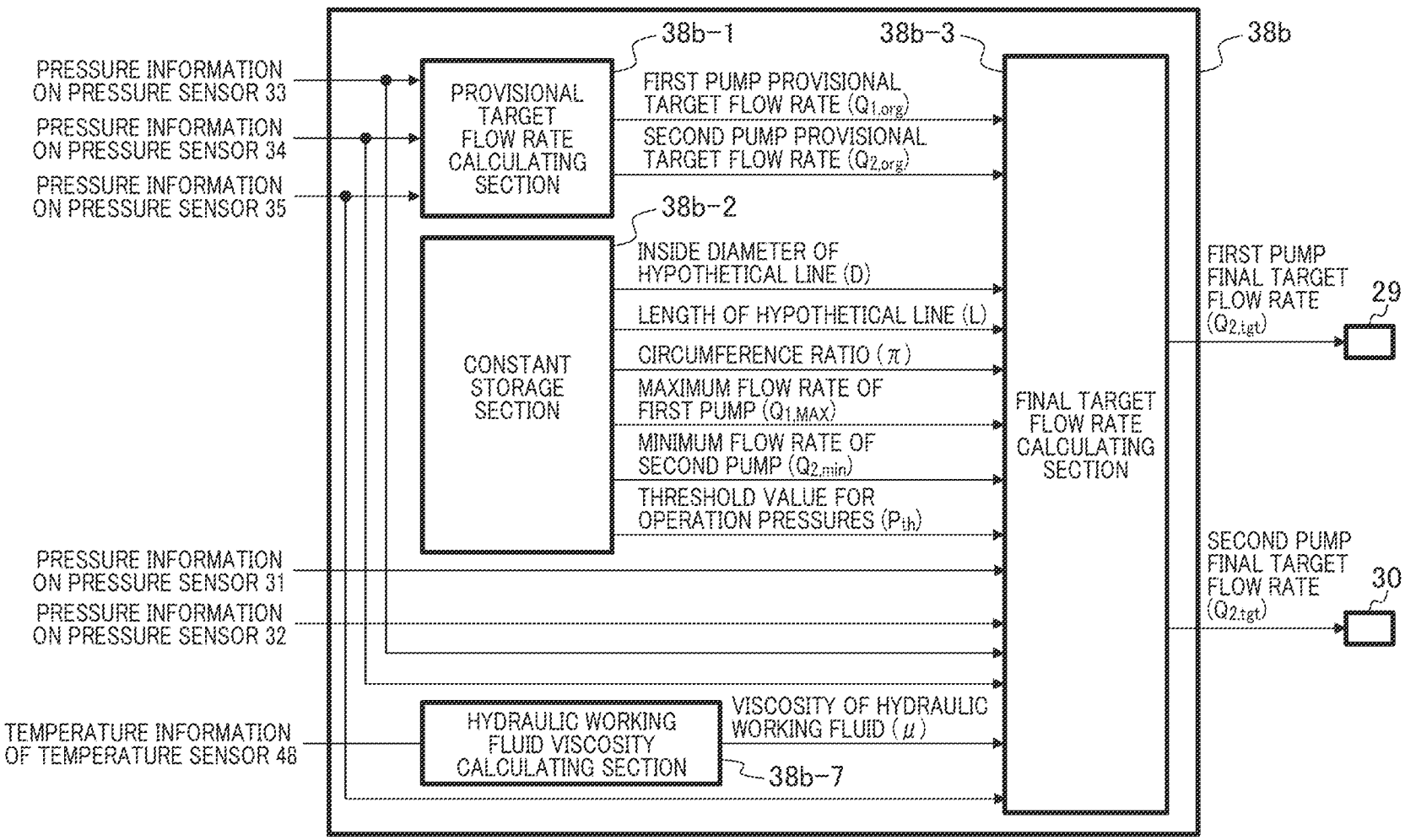
FIG. 25 is a diagram illustrating functions of a hydraulic pump target flow rate calculating section for a fifth embodiment.

A fifth embodiment of the present invention will be described below with reference to FIGS. 25 through 27. Since the present embodiment is based on the fourth embodiment, the components that are identical to those for the fourth embodiment will be omitted from description.

Functions of the hydraulic pump target flow rate calculating section 38*b* and a process of calculating a viscosity of the hydraulic working fluid for the fifth embodiment will be described below with reference to FIGS. 25 and 26.

The functions of the hydraulic pump target flow rate calculating section 38*b* for the fifth embodiment are different from the functions of the hydraulic pump target flow rate calculating section 38*b* for the fourth embodiment (illustrated in FIG. 23) in that the information on the constants transmitted from the constant storage section 38*b*-2 to the final target flow rate calculating section 38*b*-3 represents an inside diameter (D) and a length (L) of the hypothetical joint line 41, a circumference ratio (n), the maximum flow rate (Q1, MAX) of the first pump 1, the minimum flow rate (Q2, min) of the second pump 2, and the threshold value (Pth) for operation pressures, and that the hydraulic pump target flow rate calculating section 38*b* has a hydraulic working fluid viscosity calculating section 38*b*-7 instead of the hydraulic working fluid density calculating section 38*b*-6. The hydraulic working fluid viscosity calculating section 38*b*-7 is supplied with the temperature information input from the temperature sensor 48, and outputs the viscosity (p) of the hydraulic working fluid. The final target flow rate calculating section 38*b*-3 receives information on the viscosity (p) of the hydraulic working fluid from the hydraulic working fluid viscosity calculating section 38*b*-7.

Figure 26:
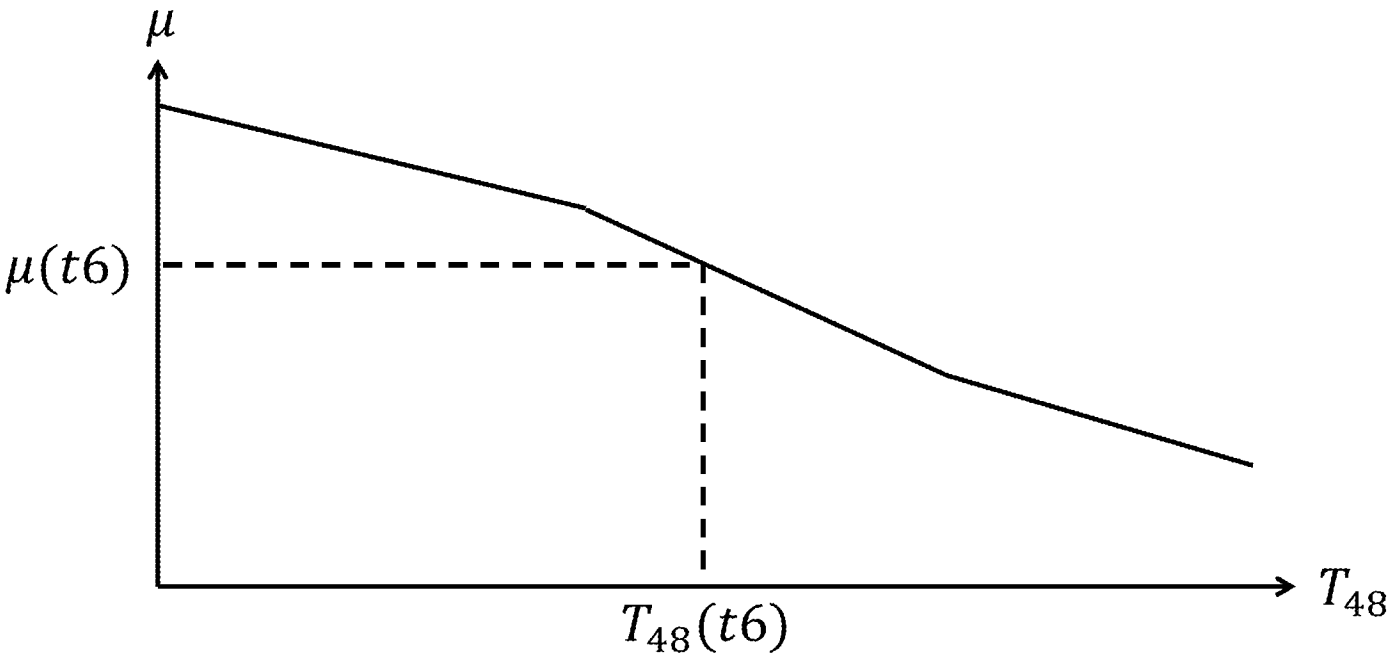
FIG. 26 is a diagram illustrating a process of calculating a viscosity of a hydraulic working fluid for the fifth embodiment.

The hydraulic working fluid density calculating section 38*b*-6 determines the viscosity (p) of the hydraulic working fluid by using a table illustrated in FIG. 26. For example, if the temperature from the temperature sensor 48 is a value T48(*t*6) at time t6, then the hydraulic working fluid viscosity calculating section 38*b*-7 outputs a value p(t6).

Next, a computation formula for computing the flow rate in the hypothetical joint line 41 for the fifth embodiment will be described below with reference to FIG. 27.

FIG. 27 illustrates a process of computing a flow rate that is used in the processing of step S105 illustrated in FIG. 7. The process is different from that for the fourth embodiment (illustrated in FIG. 8) in that the hypothetical flow rate (Qv) is computed using a choke equation.

The work machine 100 for the present embodiment further includes the temperature sensor 48 for detecting the temperature of the hydraulic working fluid. The controller 38 computes the viscosity (p) of the hydraulic working fluid on the basis of the temperature of the hydraulic working fluid detected by the temperature sensor 48 and computes the hypothetical flow rate (Qv) on the basis of the first pump discharge pressure (P31), the second pump discharge pressure (P32), the opening degree of the hypothetical restrictor 40, and the viscosity (p) of the hydraulic working fluid.

The fifth embodiment of the present invention thus arranged is capable of realizing operability and energy saving ability that are equivalent to those of work machines that have a joint line to be used during swinging/boom raising operation, taking into account effects due to changes in the viscosity of the hydraulic working fluid, without incorporating a joint line for supplying a pressurized fluid from the second pump 2 to the bottom-side chamber 17B of the boom cylinder 17.

Although the embodiments of the present invention have been described in detail above, the present invention is not limited to the above embodiments, but covers various modifications. For example, the above-described embodiments have been described in detail for easy understanding of the present invention, and should not be limited to arrangements that include all the components described above. Furthermore, it is possible to add some of the components for a certain embodiment to some of the components for other embodiments, or to delete some of the components for a certain embodiment, or to replace some of the components for a certain embodiment with some of the components for other embodiments.

DESCRIPTION OF REFERENCE CHARACTERS

1: Hydraulic pump (first pump)
2: Hydraulic pump (second pump)
3, 4: Line
5, 6: Check valve
7, 8: Line
9, 10: Line

11, 12: Tank line
13: Boom bottom line
14: Right rotation line
15: Boom rod line
16: Left rotation line
17: Boom cylinder
17B: Bottom-side chamber
17R: Rod-side chamber
18: Swing motor
18R: Right-rotation-side chamber
18L: Left-rotation-side chamber
19: Directional control valve (boom control valve)
19*u*, 19*d*: Operation port
20: Directional control valve (swing control valve)
20*r*, 201: Operation port
21: Operation lever (boom operation device)
22: Operation lever (swing operation device)
23, 24: Pilot valve
25, 26: Line
27, 28: Line
29: Regulator (first regulator)
30: Regulator (second regulator)
31: Pressure sensor (first pump pressure sensor)
32: Pressure sensor (second pump pressure sensor)
33, 34, 35: Pressure sensor
36: Tank
37: Engine
38: Controller
38*a*: Sensor signal receiving section
38*b*: Hydraulic pump target flow rate calculating section
38*b*-1: Provisional target flow rate calculating section
38*b*-2: Constant storage section
38*b*-3: Final target flow rate calculating section
38*b*-4: Directional control valve opening calculating section
38*b*-5: Hypothetical flow rate control valve opening calculating section
38*b*-6: Hydraulic working fluid density calculating section
39: Hypothetical check valve
40: Hypothetical restrictor
41: Hypothetical joint line
42, 43: Relief valve
44: Pressure sensor (boom bottom pressure sensor)
45: Hypothetical flow rate control valve
46: Check valve
47: Line
48: Temperature sensor
100: Hydraulic excavator (work machine)
101: Lower track structure
101*a*: Track device
101*b*: Track motor
102: Upper swing structure
102*a*: Operation room
102*b*: Control valve
103: Work implement
104: Boom
105: Arm
106: Bucket
107: Arm cylinder
108: Bucket cylinder
200: Hydraulic pressure control system

The invention claimed is:

1. A work machine comprising:
a lower track structure;
an upper swing structure swingably mounted on the lower track structure;
a work implement including a boom which is angularly movably mounted on the upper swing structure;
a boom cylinder for driving the boom;
a swing motor for driving the upper swing structure;
a boom operation device for operating the boom;
a swing operation device for operating the upper swing structure;
a first pump and a second pump as variable-displacement-type hydraulic pumps;
a first regulator for controlling a delivery flow rate of the first pump;
a second regulator for controlling a delivery flow rate of the second pump;
a boom control valve for controlling a flow of a pressurized fluid supplied from the first pump to the boom cylinder;
a swing control valve for controlling a flow of a pressurized fluid supplied from the second pump to the swing motor; and
a controller configured to control the first regulator depending on an operation amount of the boom operation device and control the second regulator depending on an operation amount of the swing operation device,
wherein the controller is configured to
assume that a line for supplying the pressurized fluid from the first pump to a bottom-side chamber of the boom cylinder and the second pump are interconnected by a hypothetical joint line,
compute a hypothetical flow rate representing a flow rate in the hypothetical joint line,
compute a first pump provisional target flow rate representing a provisional target flow rate for the first pump on a basis of the operation amount of the boom operation device,
compute a second pump provisional target flow rate representing a provisional target flow rate for the second pump on a basis of an operation amount of the swing operation device,
compute a first pump final target flow rate representing a final target flow rate for the first pump by adding the hypothetical flow rate to the first pump provisional target flow rate, and
compute a second pump final target flow rate representing a final target flow rate for the second pump by subtracting the hypothetical flow rate from the second pump provisional target flow rate.

2. The work machine according to claim 1, wherein the controller is configured to
store a minimum flow rate of the second pump, and
use the minimum flow rate as the second pump final target flow rate if the second pump final target flow rate is smaller than the minimum flow rate.

3. The work machine according to claim 1, wherein the controller is configured to
store a maximum flow rate of the first pump, and
use the maximum flow rate as the first pump final target flow rate if the first pump final target flow rate is larger than the maximum flow rate.

4. The work machine according to claim 1, further comprising:
a first pump pressure sensor for detecting a first pump discharge pressure representing a discharge pressure of the first pump; and
a second pump pressure sensor for detecting a second pump discharge pressure representing a discharge pressure of the second pump,
wherein the controller is configured to
assume that the hypothetical joint line has an end connected to the second pump and another end connected to the first pump, and that a hypothetical restrictor is provided in the hypothetical joint line, and compute the hypothetical flow rate on a basis of the first pump discharge pressure, the second pump discharge pressure, and an opening degree of the hypothetical restrictor.

5. The work machine according to claim 1, further comprising:

a second pump pressure sensor for detecting a second pump discharge pressure representing a discharge pressure of the second pump; and a boom bottom pressure sensor for detecting a boom bottom pressure representing a pressure in a bottom-side chamber of the boom cylinder, wherein the controller is configured to assume that the hypothetical joint line has an end connected to the second pump and another end connected to the first pump, compute an opening degree of the boom control valve on a basis of an operation amount of the boom operation device, compute a combined opening degree representing a combination of the opening degree of the boom control valve and an opening degree of the hypothetical restrictor, and compute the hypothetical flow rate on a basis of the second pump discharge pressure, the boom bottom pressure, and the combined opening degree.

6. The work machine according to claim 1, further comprising:

a second pump pressure sensor for detecting a second pump discharge pressure representing a discharge pressure of the second pump; and a boom bottom pressure sensor for detecting a boom bottom pressure representing a pressure in a bottom-side chamber of the boom cylinder, wherein the controller is configured to assume that the hypothetical joint line has an end connected to the second pump and another end connected to a boom bottom line interconnecting the bottom-side chamber of the boom cylinder and the boom control valve, and that a hypothetical flow rate control valve is provided in the hypothetical joint line, compute an opening degree of the hypothetical flow rate control valve on a basis of an operation amount of the boom operation device, and compute the hypothetical flow rate on a basis of the second pump discharge pressure, the boom bottom pressure, and the opening degree of the hypothetical flow rate control valve.

7. The work machine according to claim 1, further comprising:

a second pump pressure sensor for detecting a second pump discharge pressure representing a discharge pressure of the second pump; and a boom bottom pressure sensor for detecting a boom bottom pressure representing a pressure in a bottom-side chamber of the boom cylinder, wherein the controller is configured to assume that the hypothetical joint line has an end connected to the second pump and another end connected to the first pump, and that a hypothetical flow rate control valve is provided in the hypothetical joint line, compute an opening degree of the hypothetical flow rate control valve on a basis of an operation amount of the boom operation device, and compute the hypothetical flow rate on a basis of the second pump discharge pressure, the first pump discharge pressure, and the opening degree of the hypothetical flow rate control valve.

8. The work machine according to claim 4, further comprising:

a temperature sensor for detecting a temperature of a hydraulic working fluid, wherein the controller is configured to compute a density of the hydraulic working fluid on a basis of the temperature of the hydraulic working fluid detected by the temperature sensor, and compute the hypothetical flow rate on a basis of the first pump discharge pressure, the second pump discharge pressure, the opening degree of the hypothetical restrictor, and the density of the hydraulic working fluid.

9. The work machine according to claim 4, further comprising:

a temperature sensor for detecting a temperature of a hydraulic working fluid, wherein the controller is configured to compute a viscosity of the hydraulic working fluid on a basis of the temperature of the hydraulic working fluid detected by the temperature sensor, and compute the hypothetical flow rate on a basis of the first pump discharge pressure, the second pump discharge pressure, the opening degree of the hypothetical restrictor, and the viscosity of the hydraulic working fluid.

* * * * *